US009891583B2

(12) United States Patent
Yamaguchi et al.

(10) Patent No.: US 9,891,583 B2
(45) Date of Patent: Feb. 13, 2018

(54) REMANUFACTURING METHOD OF DEVELOPER ACCOMMODATING UNIT

(71) Applicant: CANON KABUSHIKI KAISHA, Tokyo (JP)

(72) Inventors: Noritomo Yamaguchi, Kawasaki (JP); Yuichi Fukui, Yokosuka (JP); Satoshi Nishiya, Machida (JP); Jun Miura, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/403,985

(22) Filed: Jan. 11, 2017

(65) Prior Publication Data

US 2017/0123372 A1 May 4, 2017

Related U.S. Application Data

(63) Continuation of application No. 14/920,575, filed on Oct. 22, 2015, now Pat. No. 9,575,434.

(30) Foreign Application Priority Data

Oct. 27, 2014 (JP) ..... 2014-218518

(51) Int. Cl.
*G03G 21/18* (2006.01)
*G03G 15/08* (2006.01)

(52) U.S. Cl.
CPC ..... *G03G 21/181* (2013.01); *G03G 15/0894* (2013.01)

(58) Field of Classification Search
CPC ..... G03G 2215/00995; G03G 2215/00987; G03G 21/181; G03G 15/0894
See application file for complete search history.

(56) References Cited

U.S. PATENT DOCUMENTS 5,761,584 A * 6/1998 Tsuda ..... G03G 21/1821 141/364
2008/0193168 A1* 8/2008 Moon ..... G03G 15/0887 399/254

* cited by examiner

*Primary Examiner* — Gregory H Curran
(74) *Attorney, Agent, or Firm* — Canon U.S.A., Inc. IP Division

(57) ABSTRACT

Provided is a remanufacturing method of a developer accommodating unit including a flexible container provided with an opening and configured to accommodate developer, and a frame member configured to accommodate the flexible container. The remanufacturing method includes refilling the developer into the frame member.

19 Claims, 24 Drawing Sheets

REMANUFACTURING METHOD OF DEVELOPER ACCOMMODATING UNIT

CROSS-REFERENCE TO RELATED APPLICATIONS

This application is a Continuation of U.S. application Ser. No. 14/920,575, filed Oct. 22, 2015, which claims the benefit of Japanese Patent Application No. 2014-218518, filed Oct. 27, 2014, all of which are hereby incorporated by reference herein in their entirety.

BACKGROUND OF THE INVENTION

Field of the Invention

The present invention relates to a remanufacturing method of a developer accommodating unit for refilling developer.

An image forming apparatus forms an image on a recording medium using an electrophotographic image forming process. Examples of image forming apparatuses include electrophotographic copying machines, electrophotographic printers (for example, laser beam printers and light emitting diode (LED) printers), facsimile apparatuses, and word processors.

A developing device includes developer, and a developing roller as a developer bearing member for developing an electrostatic latent image formed on a photosensitive drum as an image bearing member. The developing device is detachably attached to an image forming apparatus or a photosensitive drum unit including a photosensitive drum.

A cartridge (process cartridge) integrally includes a photosensitive drum and a developing roller, and is detachably attached to an image forming apparatus.

Description of the Related Art

Japanese Patent No. 3320403 discloses a remanufacturing method of a cartridge having a developing device, more specifically, a remanufacturing method of a cartridge for refilling, using a funnel, toner into a storage container for storing toner, after removing a developing roller and a developing blade.

SUMMARY OF THE INVENTION

The present invention is directed to a remanufacturing method of a developer accommodating unit including a flexible container.

According to an aspect of the present invention, a remanufacturing method of a developer accommodating unit including a flexible container provided with an opening and configured to accommodate developer, and a frame member configured to accommodate the flexible container, includes refilling the developer into the frame member.

Further features of the present invention will become apparent from the following description of embodiments with reference to the attached drawings.

DESCRIPTION OF THE EMBODIMENTS

Figure 1:
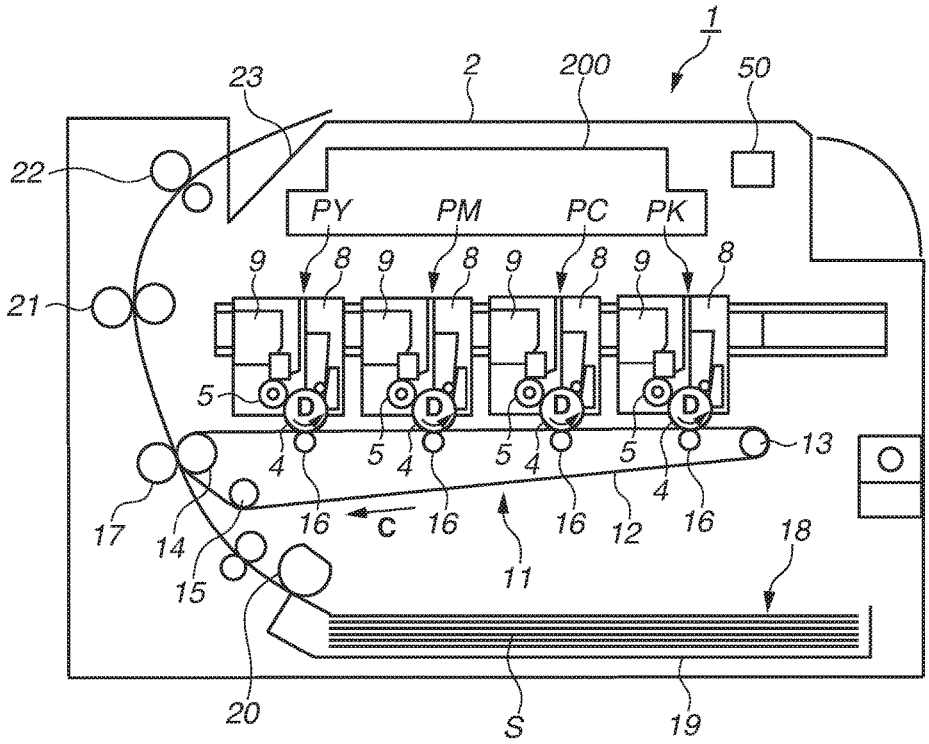
FIG. 1 is a sectional view illustrating an image forming apparatus.

Embodiments of the present invention will be described in detail below with reference to the accompanying drawings. However, sizes, materials, shapes, and relative positions of elements described in the embodiments are not limited thereto, and can be appropriately modified depending on the configuration of an apparatus according to the present invention and other various conditions. Unless otherwise specifically described, the scope of the present invention is not limited to the embodiments described below. Elements in subsequent embodiments that are identical to those in preceding embodiments are assigned the same reference numerals, and descriptions in the preceding embodiments will be incorporated by reference.

In the following descriptions, a developer accommodating unit includes at least a frame member and a flexible container. A developing device includes at least a developer bearing member. Further, a process cartridge includes at least an image bearing member. In the embodiments, a developer accommodating unit has the same concept as a developing device. In the embodiments, a developing unit may be independently configured as a developing device.

First Embodiment

FIG. 1 is a sectional view illustrating an image forming apparatus 1. The image forming apparatus 1 performs full color image formation, and is provided with an apparatus body 2. Inside the apparatus body 2, four cartridges P are detachably attached. In the following descriptions of the image forming apparatus 1, the front surface is on the right side, the rear surface is on the left side, the drive side is on the rear side, and the non-drive side is on the front side, as illustrated in FIG. 1. The cartridges P attached to the apparatus body 2 are the following four cartridges: a first cartridge PY, a second cartridge PM, a third cartridge PC, and a fourth cartridge PK. These cartridges P are disposed in a horizontal direction.

These cartridges P have an approximately similar configuration expect for different toner colors. The first cartridge PY accommodates yellow developer, the second cartridge PM accommodates magenta developer, the third cartridge PC accommodates cyan developer, and the fourth cartridge PK accommodates black developer. The image forming apparatus 1 performs color image formation on a recording material S. The image forming apparatus 1 is a cartridge type image forming apparatus in which the cartridges P are detachably attached to the apparatus body 2 and a color image is formed on the recording material S.

A mechanism inside the cartridge P is driven by a rotational driving force received from a drive output unit (not illustrated) of the apparatus body 2. Internal devices in the cartridge P is supplied with bias voltages (a charging bias voltage, a developing bias voltage, etc.) from the apparatus body 2.

An exposure device 200 is disposed above the plurality of cartridges P. The exposure device 200 is a laser scanner unit for irradiating a photosensitive drum 4 with laser light LS based on information transmitted from a controller 50 in the apparatus body 2. This laser light LS passes through an exposure window portion 10 (refer to FIG. 2) inside the cartridge P, and the surface of the photosensitive drum 4 is exposed to the laser light LS to be scanned.

An intermediate transfer belt unit 11 is disposed below the plurality of cartridges P. The intermediate transfer belt unit 11 includes a transfer belt 12, and a drive roller 13 and tension rollers 14 and 15 for stretching the transfer belt 12. The transfer belt 12 is made of a flexible material.

The bottom surface of the photosensitive drum 4 inside the cartridge P contacts the upper surface of the transfer belt 12. The relevant contact portion is a primary transfer portion. Inside the transfer belt 12, primary transfer rollers 16 are disposed to surface respective photosensitive drums 4. A secondary transfer roller 17 is disposed at a position facing the tension roller 14 via the transfer belt 12. The contact portion between the secondary transfer roller 17 and the transfer belt 12 is a secondary transfer portion.

A feed unit 18 is disposed below the intermediate transfer belt unit 11. The feed unit 18 includes a tray 19 on which recording materials S are stacked, and a feed roller 20. A fixing unit 21 and a discharge unit 22 are disposed at the upper left position of the cartridge P. A discharge tray 23 is formed on the upper surface of the apparatus body 2. The recording material S is fixed by the fixing unit 21 and then discharged onto the discharge tray 23.

Figure 2:
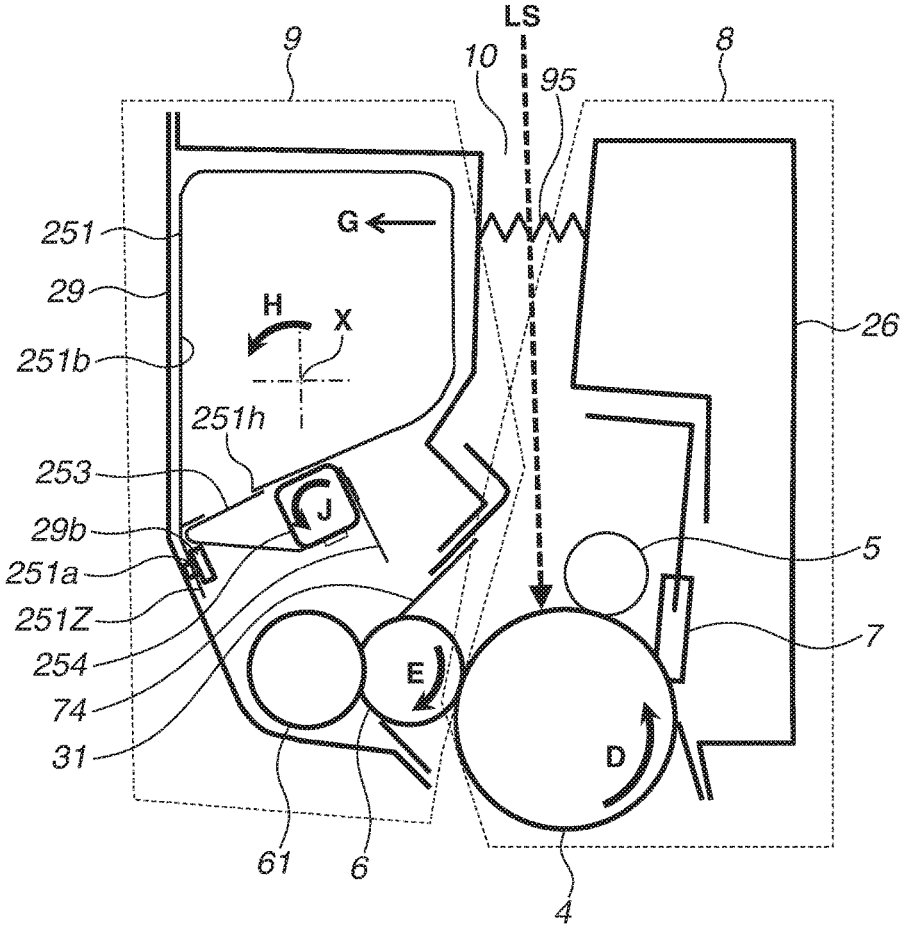
FIG. 2 is a sectional view illustrating a cartridge.

FIG. 2 is a sectional view illustrating the cartridge P. The cartridge P includes a photosensitive unit 8 and a developing unit 9. The photosensitive unit 8 includes the photosensitive drum 4 as an "image bearing member", a charging roller 5, and a cleaning member 7. The charging roller 5 uniformly charges the surface of the photosensitive drum 4. The cleaning member 7 is a blade for removing residual toner that has been developed on the surface of the photosensitive drum 4, but has not been transferred onto the primary transfer roller 16.

The developing unit 9 includes a developing roller 6 as a "developer bearing member", a supply roller 61, and an agitating member 74. The developing roller 6 develops an electrostatic image on the surface of the photosensitive drum 4 using toner. The supply roller 61 supplies developer to the developing roller 6. The agitating member 74 agitates the developer inside the developing unit 9.

Operations of the image forming apparatus 1 will be described below with reference to above-described FIGS. 1 and 2. The surface of the photosensitive drum 4 is uniformly charged by the charging roller 5 and then is exposed to light by the exposure device 200, so that an electrostatic image is formed on the surface of the photosensitive drum 4. When the electrostatic image is developed by the developing unit 9 using the developer, a developer image is formed. The developer image on the surface of the photosensitive drum 4 is transferred onto the transfer belt 12 rotating in a forward direction (the direction indicated by an arrow C illustrated in FIG. 1) of the rotational direction of the photosensitive drum 4. Yellow, magenta, cyan, and black developer images are primarily transferred sequentially from the respective photosensitive drums 4 of the first to the fourth cartridges P onto the transfer belt 12 to be superimposed upon one another.

Meanwhile, the recording materials S stacked on the tray 19 are separated and fed one by one at a predetermined control timing. Each of the recording materials S is conveyed to the secondary transfer portion between the secondary transfer roller 17 and the transfer belt 12. At the secondary transfer portion, the developer image on the surface of the transfer belt 12 is secondarily transferred onto the recording material S.

The developing unit 9 includes a sealing member 253 for sealing openings 251*h* (251*h*1 to 251*h*5) and exposing the openings 251*h*1 to 251*h*5 when being moved, and an unsealing member 254 attached to the sealing member 253, for moving the sealing member 253. The developing unit 9 further includes a fixing portion 29*b* for fixing a flexible container 251 to the frame member 29.

Figure 3:
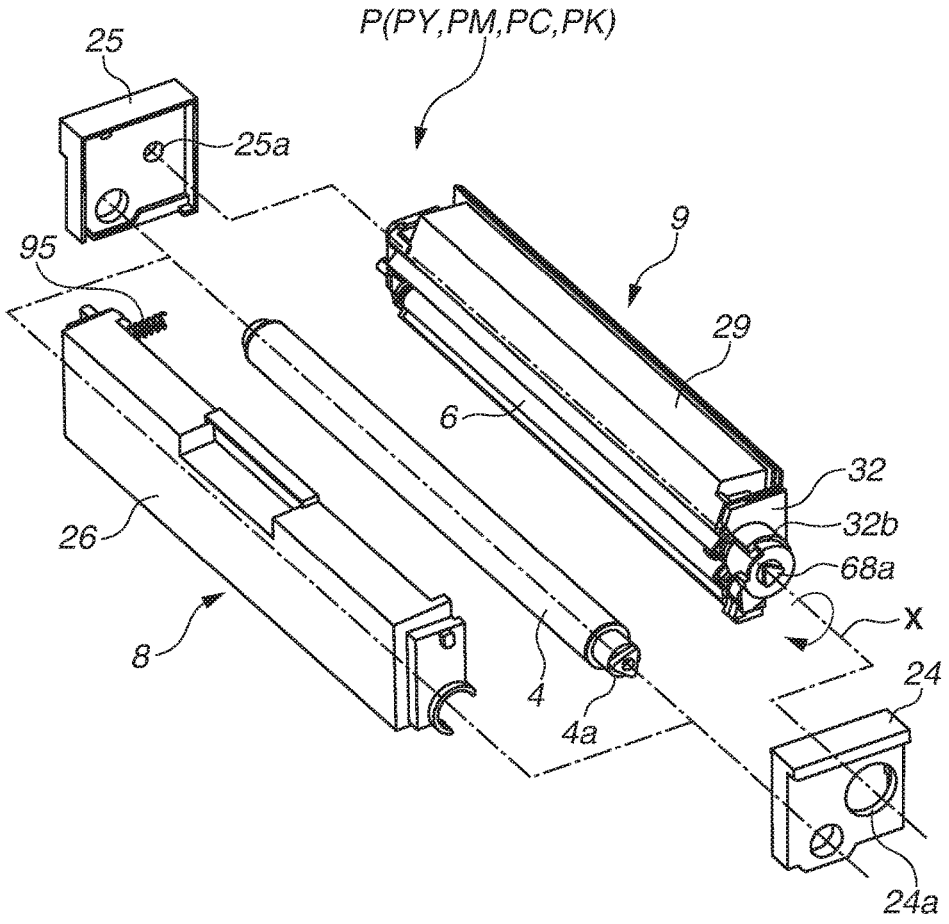
FIG. 3 is a perspective view illustrating the cartridge viewed from a drive side.
Figure 4:
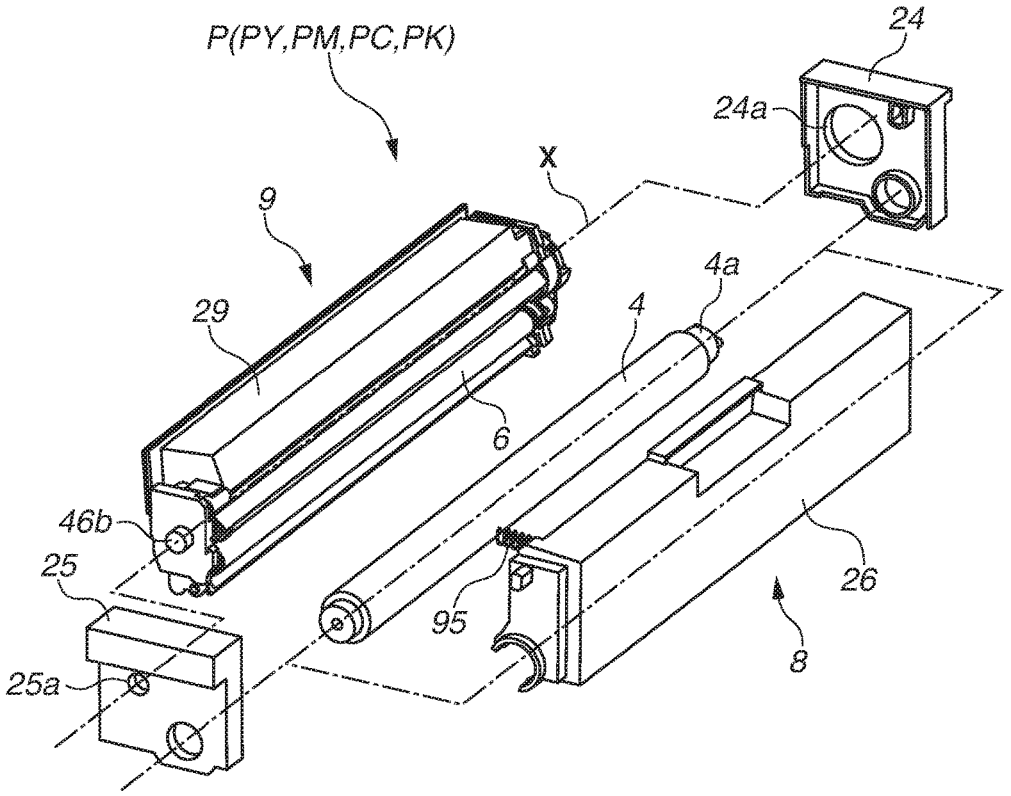
FIG. 4 is a perspective view illustrating the cartridge viewed from a non-drive side.

FIG. 3 is a perspective view illustrating the cartridge P viewed from the drive side. FIG. 4 is a perspective view illustrating the cartridge P viewed from the non-drive side. As illustrated in FIGS. 3 and 4, the photosensitive unit 8 and the developing unit 9 are integrally formed by covers 24 and 25. Therefore, the photosensitive unit 8 includes the photosensitive drum 4, the charging roller 5, the cleaning member 7, a cleaning container 26, and the covers 24 and 25. The photosensitive drum 4 is rotatably supported on the cleaning container 26 by the covers 24 and 25.

One end side of the photosensitive drum 4 in the longitudinal direction is provided with a coupling member 4*a* for transmitting a driving force to the photosensitive drum 4. When the coupling member 4*a* is engaged with a drum drive output unit of the apparatus body 2, the driving force of the drive motor (not illustrated) of the apparatus body 2 is transmitted to the photosensitive drum 4. The charging roller 5 is supported by the cleaning container 26 so that the charging roller 5 can be rotatably driven with being in contact with the photosensitive drum 4. The cleaning member 7 is supported by the cleaning container 26 so that the cleaning member 7 contacts the circumferential surface of the photosensitive drum 4 at a predetermined pressure.

Residual developer removed from the circumferential surface of the photosensitive drum 4 by the cleaning member 7 is stored in the cleaning container 26. Holes 24*a* and 25*a* for rotatably supporting the developing unit 9 are formed on the covers 24 and 25, respectively.

Figure 5:
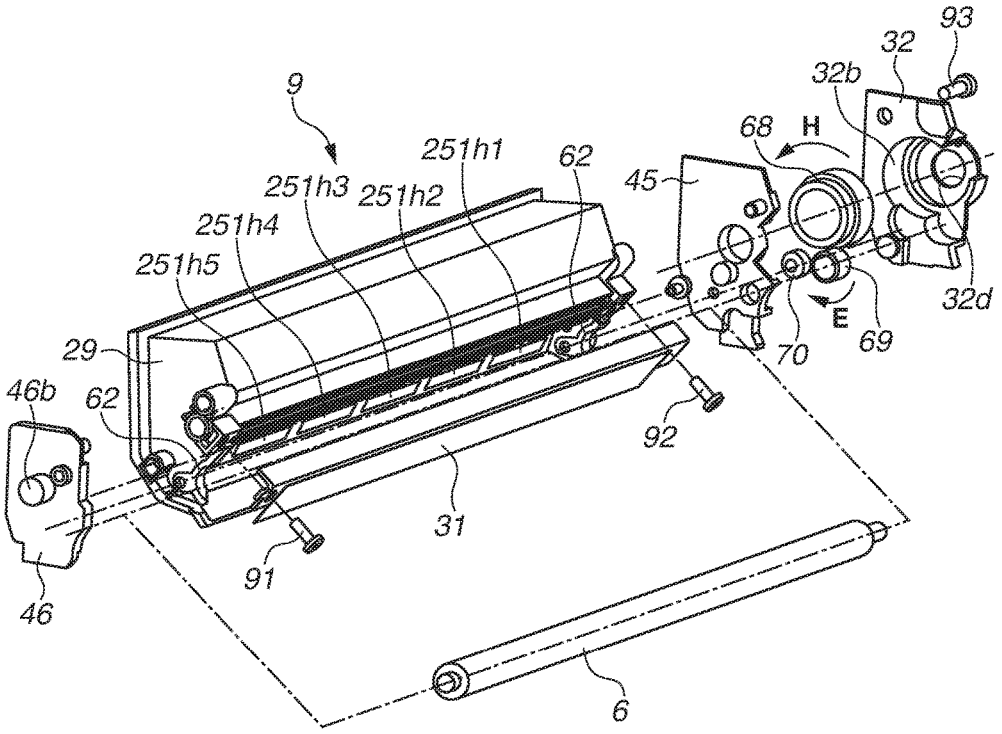
FIG. 5 is an exploded perspective view illustrating a developing unit.

FIG. 5 is an exploded perspective view illustrating the developing unit 9. The flexible container 251 illustrated in FIG. 2 is stored in the developing unit 9 illustrated in FIG. 5. As illustrated in FIG. 5, the developing unit 9 includes the developing roller 6, a developing blade 31, the frame member 29, bearings 45 and 46, and a cover 32. The developing unit 9 refers to a unit including at least the flexible container 251, the sealing member 253, and the unsealing member 254 inside the frame member 29 (refer to FIG. 2). The developing unit 9 includes the flexible container 251 for storing developer T, and the frame member 29 for storing the flexible container 251. The flexible container 251 is provided with the openings 251*h*1 to 251*h*5 for discharging the developer T.

As illustrated in FIG. 2, the flexible container 251 is provided with a fixed member 251Z on which a hole 251*a* for fixing the flexible container 251 to the frame member 29 is formed, an accommodating portion 251*b* for accommodating (storing) the developer, and the openings 251*h* (251*h*1 to 251*h*5) for discharging the developer. When the cartridge P is new, since the openings 251*h* (251*h*1 to 251*h*5) are covered by the sealing member 253 detachably welded to the flexible container 251, the developer is sealed inside the flexible container 251.

The sealing member 253 is coupled to the unsealing member 254. The unsealing member 254 is supported so as to be rotatable in the direction indicated by an arrow J by receiving a driving force from the apparatus body 2. When the new cartridge P is used, the cartridge P is attached to the apparatus body 2. Then, the unsealing member 254 receives a driving force from the apparatus body 2 to rotate.

At this timing, the sealing member 253 is detached from the flexible container 251 and is rolled up by the unsealing member 254. Thus, the openings 251*h* (251*h*1 to 251*h*5) of the flexible container 251 are exposed, enabling the developer in the flexible container 251 to be discharged into the frame member 29.

The developing blade 31 for regulating the layer thickness of the developer on the circumferential surface of the developing roller 6 is fixed to the frame member 29. The bearings 45 and 46 illustrated in FIG. 5 are fixed at both ends of the frame member 29 in the longitudinal direction. Gears 70, 69, and 68 are disposed on the drive side end. The shaft of the supply roller 61 is fitted into the gear 70. The shaft of the developing roller 6 is fitted into the gear 69. The shaft of the agitating member 74 (FIG. 2) is fitted into the gear 68.

The gear 69 is set to rotate when the gear 68 rotates. The bearing 45 is provided with the gears 68, 69, and 70. The cover 32 is fixed to the outside of the gears 68, 69, and 70. End seals 62 are disposed at both ends of the shaft of the supply roller 61 to seal between the supply roller 61 and the frame member 29.

As illustrated in FIG. 5, the cover 32 is provided with a cylindrical portion 32*b*. A drive transmission portion 68*a* (refer to FIG. 3) of the gear 68 is exposed through an opening 32*d* inside the cylindrical portion 32*b*. When the cartridge P is attached to the apparatus body 2, the drive transmission portion 68*a* of the gear 68 is engaged with an apparatus body drive transmission member (not illustrated), so that a driving force from a drive motor (not illustrated) provided in the apparatus body 2 is transmitted. The driving force input from the apparatus body 2 to the gear 68 is transmitted to the developing roller 6 via the gear 69.

[Photosensitive Unit and Developing Unit Assembling Process]

As illustrated in FIGS. 3 and 4, when assembling the developing unit 9 and the photosensitive unit 8, the outer diameter portion of the cylindrical portion 32*b* of the cover 32 is fitted into the hole 24*a* of the cover 24 on one end side. Then, a protruding portion 46*b* protruding from the bearing 46 is fitted into the hole 25*a* of the cover 25 on the other end side. Thus, the developing unit 9 is supported so as to be rotatable with respect to the photosensitive unit 8. The developing unit 9 is rotatable around an axis line connecting the hole 24*a* of the cover 24 and the hole 25*a* of the cover 25. The rotation center of the developing unit 9 is referred to as a rotation center X.

As illustrated in FIG. 2, the developing unit 9 is urged by a pressure spring 95 as an elastic member so that the developing roller 6 contacts the photosensitive drum 4 around the rotation center X. More specifically, the developing unit 9 is pressed in the direction indicated by an arrow G illustrated in FIG. 2 by an urging force of the pressure spring 95 so that a moment in the direction indicated by an arrow H acts around the rotation center X.

Referring to FIG. 5, the gear 68 receives a rotational driving force in the direction indicated by the arrow H (refer to FIG. 2) from an apparatus body drive transmission member (not illustrated) provided on the apparatus body 2. The gear 69 engaged with the gear 68 thereby rotates in the direction indicated by an arrow E. Likewise, the developing roller 6 thereby rotates in the direction indicated by the arrow E. When a driving force required for rotating the developing roller 6 is input to the gear 68, a rotational moment in the direction indicated by the arrow H arises in the developing unit 9.

A pressing force of the above-described pressure spring 95 (refer to FIG. 2) and a rotational driving force from the apparatus body 2 cause the developing unit 9 to receive a moment in the direction indicated by the arrow H around the rotation center X. Then, the developing roller 6 contacts the photosensitive drum 4 at a predetermined pressure. Although, in the first embodiment, two forces, i.e., the pressing force by the pressure spring 95 and the rotational driving force from the apparatus body 2 are used to press the developing roller 6 against the photosensitive drum 4, only either one force may be used for the relevant purpose.

With the cartridge P being attached to the inside of the apparatus body 2, image formation is performed while consuming the developer inside the developing unit 9. The remanufacturing method of the cartridge P of refilling the developer into the developing unit 9 after consuming the developer inside the developing unit 9 will be sequentially described below.

[Unit Separation Process]

A unit separation process for separating the photosensitive unit 8 and the developing unit 9 of the cartridge P will be described below. As illustrated in FIG. 3, when the covers 24 and 25 are removed from the cleaning container 26, the developing unit 9 and the photosensitive unit 8 can be separated. As described above, since the covers 24 and 25 and the cleaning container 26 rotatably support the photosensitive drum 4, the above-described unit separation process enables the separation of the photosensitive drum 4 from the photosensitive unit 8.

[Developing Unit Disassembling Process]

A process for disassembling the developing unit 9 will be described below with reference to FIG. 5. First of all, the cover 32 provided at the drive side end of the developing unit 9 is separated from the frame member 29. When the cover 32 is fixed to the bearing 45 and the frame member 29 with a screw 93, the screw 93 is removed and then the cover 32 is separated from the developing unit 9.

Then, on the drive side of the developing unit 9, the gears 68, 69, and 70 disposed inside the cover 32 in the longitudinal direction are separated from the developing unit 9. The gear 68 is slidably supported by the cover 32 and the bearing 45, and the gear 69 is fitted into an end of the shaft of the developing roller 6. The gear 70 is fitted into the shaft of the supply roller 61. Therefore, the gears 68, 69, and 70, the developing roller 6, and the supply roller 61 can be easily separated from the developing unit 9.

Then, the bearings 45 and 46 and the developing roller 6 are separated from the developing unit 9. When the bearing 45 is fixed to the frame member 29 with a screw, the screw is removed and then the bearing 45 is separated from the frame member 29. In the present embodiment, the bearing 45 and the cover 32 are fixed together to the frame member 29 with the screw 93. Since the screw 93 has been removed when the cover 32 is separated from the frame member 29, the bearing 45 can be easily separated from the frame member 29. Likewise, when the bearing 46 is fixed to the frame member 29 with a screw, the bearing 46 can be separated from the frame member 29 after the screw is removed.

As described above, the developing roller 6 is slidably supported on the frame member 29 by the bearings 45 and 46. Therefore, in a state where the bearings 45 and 46 are separated from the frame member 29, the developing roller 6 can be easily separated from the frame member 29. Although, in the above descriptions, a process for separating both the bearings 45 and 46 from the frame member 29 is performed to separate the developing roller 6 from the frame member 29, the method is not limited thereto. For example, after only the bearing 46 is separated from the frame member 29, the developing roller 6 may be pulled out toward the non-drive side to separate the developing roller 6 from the frame member 29.

Then, the developing blade 31 is separated from the frame member 29. When the developing blade 31 is fixed to the frame member 29 with screw 91 and 92, the screws 91 and 92 are removed and then the developing blade 31 is separated from the frame member 29.

Figure 24A:
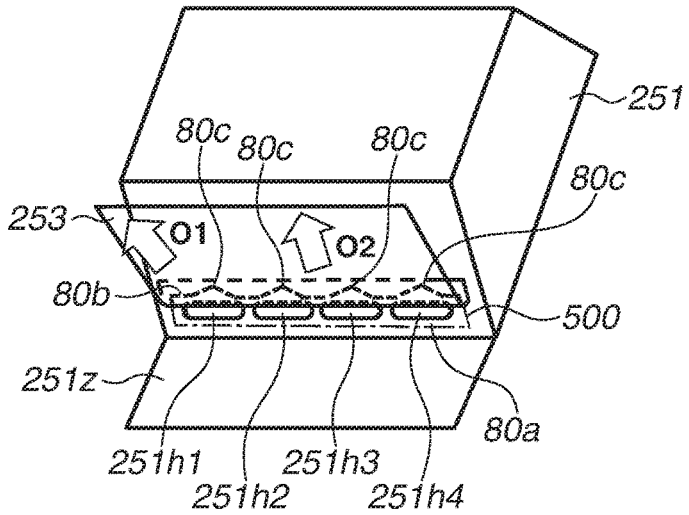
FIGS. 24A, 24B, and 24C are perspective views illustrating a process for detaching the sealing member from the flexible container.
Figure 24B:
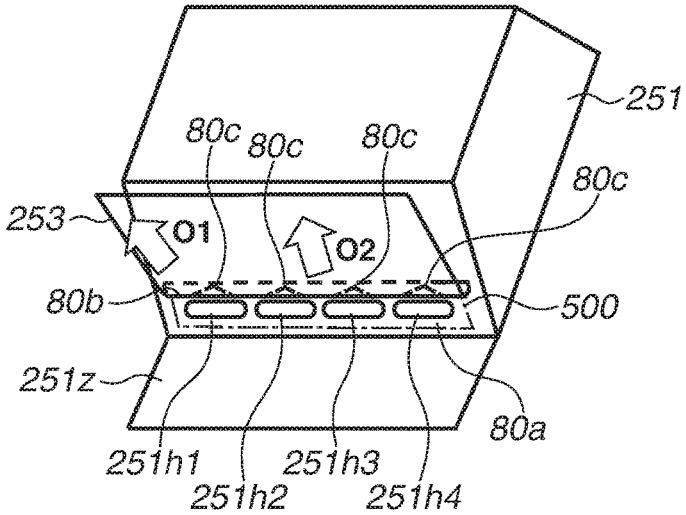
Figure 24C:
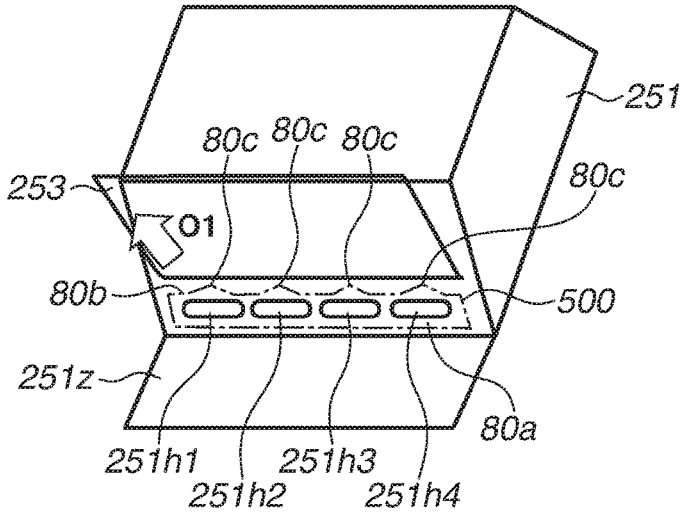

FIGS. 24A, 24B, and 24C are perspective views illustrating a process for detaching the sealing member 253 from the flexible container 251. The flexible container 251 is accommodated (stored) inside the frame member 29. When the unsealing member 254 rotates, the sealing member 253 is separated from an attachment and detachment area 500 around the openings 251*h*1 to 251*h*4 of the accommodating portion 251*b* of the flexible container 251. Although four openings 251*h* are illustrated in FIGS. 24A, 24B, and 24C, there are five openings 251*h* in the present embodiment.

The attachment and detachment area 500 has two different portions on the downstream side in the detachment direction: parallel portions 80*b* parallel to the axis direction of the developing roller 6, and mountain-shaped portions 80*c* having a mountain shape toward the downstream side in the detachment direction. The attachment and detachment area 500 further includes a detachment start portion 80*a* parallel to the axis direction of the developing roller 6, at the upstream side in the detachment direction. The sealing member 253 is pulled in the direction indicated by an arrow O1 and the direction indicated by the arrow O2 to be detached in states illustrated in FIGS. 24A, 24B, and 24C in this order.

(Flexible Container Compression Process)

Figure 6:
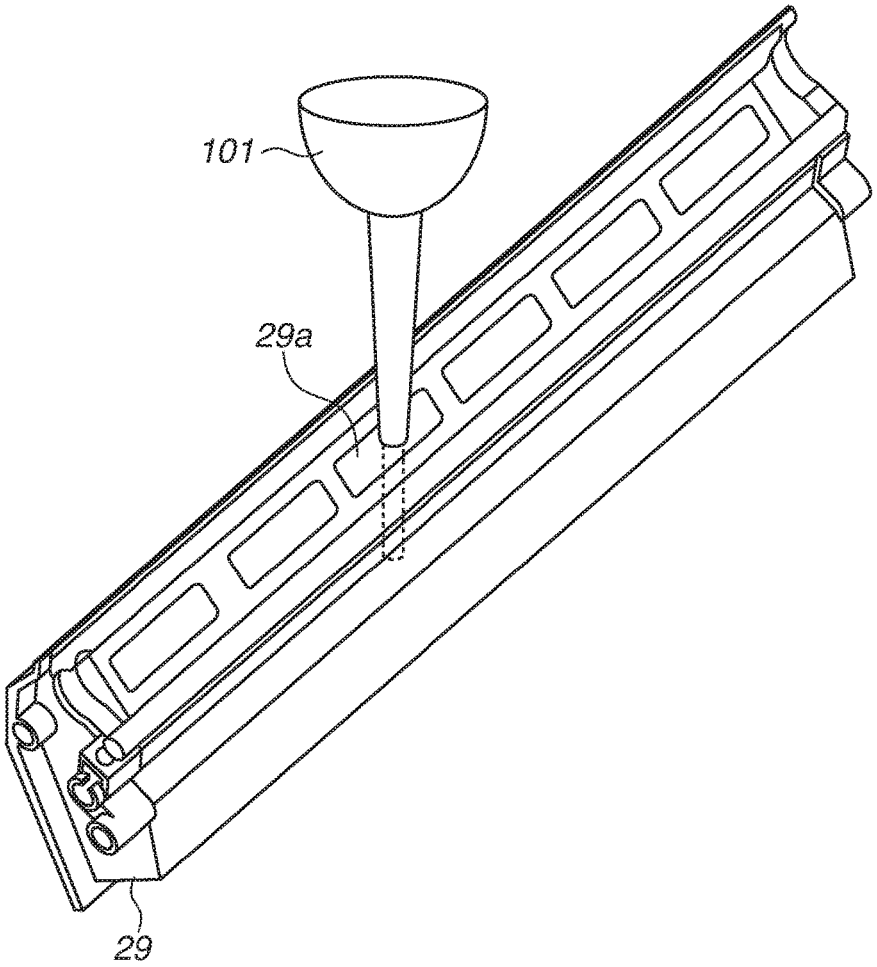
FIG. 6 is a perspective view illustrating a frame member in which a funnel is inserted.
Figure 7A:
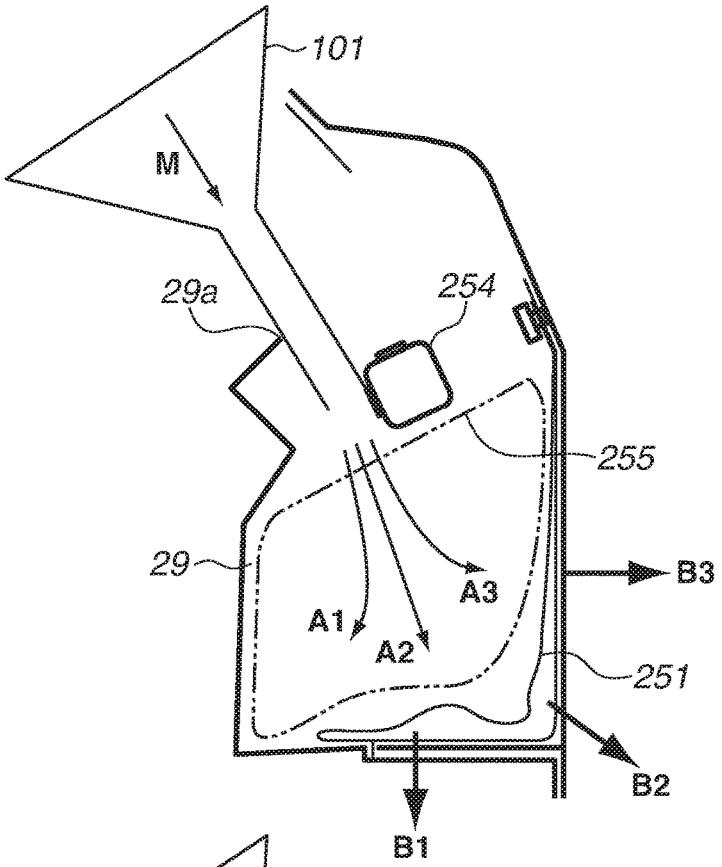
FIG. 7A is a sectional view illustrating the developing unit.

FIG. 6 is a perspective view illustrating the frame member 29 in which a funnel 101 inserted. FIG. 7A is a sectional view illustrating the frame member 29 before the developer T is refilled. A process for compressing the flexible container 251 to make the capacity of the flexible container 251 inside the frame member 29 smaller than the capacity of the flexible container 251 filled with the developer T will be described with reference to FIGS. 6 and 7A. In the compression process, the tip portion of the funnel 101 is inserted into an exposed opening 29*a* of the frame member 29 as illustrated in FIG. 6. In this case, the tip portion of the funnel 101 reaches the inside of the frame member 29 as illustrated in FIG. 7A.

When air is injected into the funnel 101 in the direction indicated by an arrow M, the injected air advances in the directions indicated by arrows A (A1 to A3) inside the frame member 29. Then, the pressure of the injected air compresses the flexible container 251 in the directions indicated by arrows B (B1 to B3) to reduce the capacity of the flexible container 251. Injecting air into the frame member 29 in this way enlarges a refilling space 255, which is provided inside the frame member 29 and outside the flexible container 251. Hereinafter this space will be referred to as the refilling space 255.

The above-described procedures are summarized as follows. The remanufacturing method of the developing unit 9 includes a compression process. In the compression process, the capacity of the flexible container 251 is reduced by injecting air into the refilling space 255. In the compression process, the flexible container 251 is folded by pressing the flexible container 251 with a pressing member. Thus, the remanufacturing method of the developing unit 9 includes a compression process for compressing the flexible container 251 inside the frame member 29 to make the capacity of the flexible container 251 smaller than the capacity of the flexible container 251 filled with the developer T. The compression process enlarges the refilling space 255.

(Developer Refilling Process)

Figure 7B:
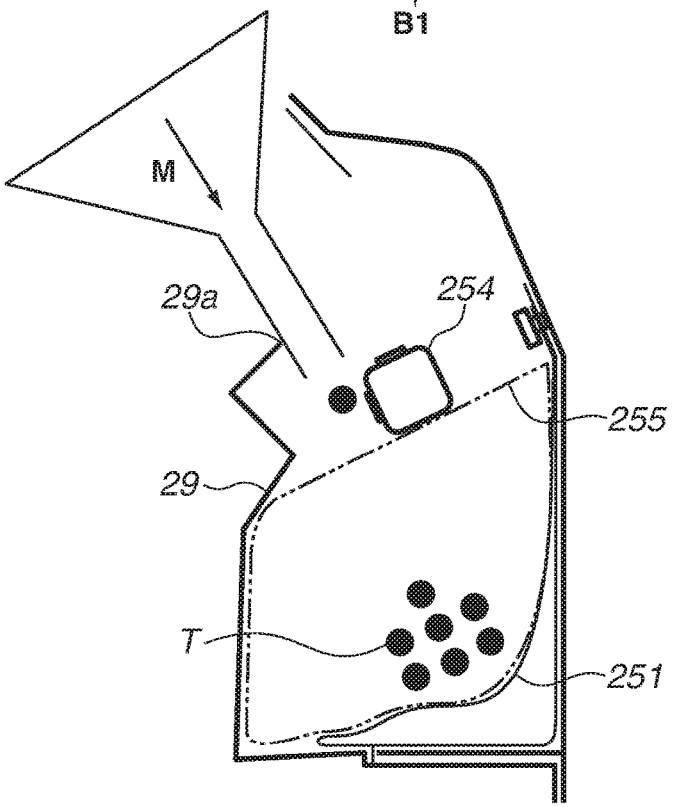
FIG. 7B is a perspective view illustrating a flexible container.

FIG. 7B is a sectional view illustrating the frame member 29 after filling the developer. The refilling process for refilling the developer into the frame member 29 will be described below with reference to FIG. 7B. In the developer refilling process, the developer T is injected into the funnel 101 in the direction indicated by the arrow M as illustrated in FIG. 7B. The injected developer T falls into the frame member 29 from the tip portion of the funnel 101, and the developer T is refilled into (or accumulated in) the refilling space 255 between the frame member 29 and the flexible container 251 (refilling process). In this way, the developer T is refilled into the frame member 29. Using a fixed-rate feeding device having an auger instead of the funnel 101 enables efficient injection of the developer T into the frame member 29.

Although, in the present embodiment, the funnel 101 is inserted into the opening 29*a* of the frame member 29, the flexible container 251 is compressed, and the developer T is refilled, the method is not limited thereto. More specifically, the above-described compression process and refilling process may be performed after a hole is formed on the frame member 29 and then the tip portion of the funnel 101 is inserted into the frame member 29.

Although, in the present embodiment, the flexible container 251 is compressed using air in the compression process so as to efficiently compress the flexible container 251, the method is not limited thereto. More specifically, in the developer refilling process, the flexible container 251 may be compressed using the developer T injected from the funnel 101 and the developer T may be filled into the frame member 29.

[Developing Unit Assembling Process]

As described above, the developer is refilled into the frame member 29 and then the cartridge P is reassembled. The cartridge P can be reassembled by performing the above-described separation process in reverse order. The reassembling method of the developing unit 9 will be described below with reference to FIG. 5.

First of all, the supply roller 61 is fitted into the frame member 29. The gap between the shaft of the supply roller 61 and the frame member 29 is sealed by the end seals 62. The developing blade 31 is fixed to the frame member 29 with the screws 91 and 92. Then, the developing roller 6 is placed in the frame member 29, and the bearings 45 and 46 are attached to the frame member 29 from both ends in the longitudinal direction.

Then, the gear 68 is fitted into the bearing 45, the gear 69 is fitted into an end of the developing roller 6, and the gear 70 is fitted into an end of the supply roller 61. Then, the cover 32 is fixed to the outside of the frame member 29 or the bearing 45 in the longitudinal direction with the screw 93 so as to cover the gears 68 and 69. Upon completion of the above-described procedure, the assembling process of the developing unit 9 is completed.

[Unit Combining Process]

A unit combining process for combining the photosensitive unit 8 and the developing unit 9 will be described below with reference to FIG. 3. In this process, the cleaning container 26, the photosensitive drum 4, and the developing unit 9 are simultaneously sandwiched between the covers 24 and 25. To hold the developing unit 9 so as to be rotatable with respect to the photosensitive unit 8, the outer diameter portion of the cylindrical portion 32*b* of the cover 32 is fitted into the hole 24*a* of the cover 24. The protruding portion 46*b* protruding from the bearing 46 is fitted into the hole 25*a* of the cover 25.

Upon completion of the above-described procedure, the assembly of the cartridge P is completed as illustrated in FIG. 2. Note that the cartridge P that has undergone the above-described processes is equivalent to the cartridge P illustrated in FIG. 2 except that the flexible container 251 is removed. The above-described remanufacturing method of the cartridge P achieves a simplified remanufacturing method of the cartridge P.

Second Embodiment

The second embodiment differs from the first embodiment in the flexible container compression process, out of the cartridge disassembling process, the flexible container compression process, the developer refilling process, and the cartridge assembling process. The flexible container compression process will be described below.

(Compression Process)

Figure 8A:
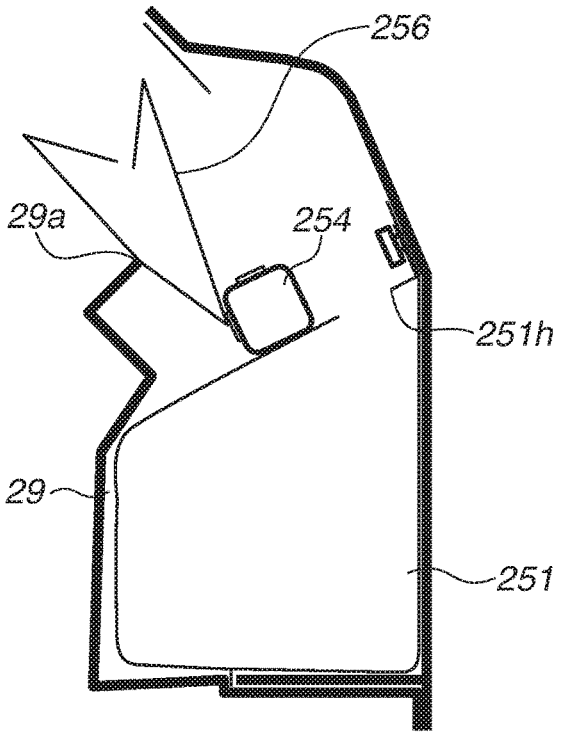
FIG. 8A is a sectional view illustrating the frame member before insertion of a flaring member.
Figure 8B:
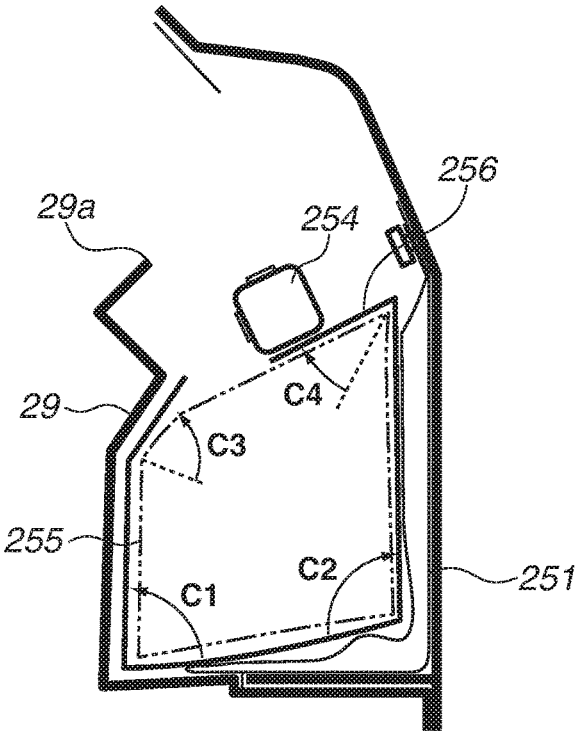
FIG. 8B is a sectional view illustrating the frame member after insertion of the flaring member.

FIG. 8A is a sectional view illustrating the frame member 29 before insertion of a flaring member 256. FIG. 8B is a sectional view illustrating the frame member 29 after insertion of the flaring member 256. A compression process for compressing the flexible container 251 inside the frame member 29 to make the capacity of the flexible container 251 smaller than the capacity of the flexible container 251 filled with the developer T will be described below with reference to FIGS. 8A and 8B. As illustrated in FIG. 8A, the flaring member 256 is expandable and foldable. When the flaring member 256 is folded, it can be inserted through a small opening such as the opening 29*a* of the frame member 29.

As illustrated in FIG. 8B, when the folded flaring member 256 is inserted into the frame member 29, the flaring member 256 expands in the directions indicated by arrows C1 to C4 illustrated in FIG. 8B inside the frame member 29. In this case, the flexible container 251 receives a force from the flaring member 256 and is compressed. Thus, the flaring member 256 compresses the flexible container 251 inside the frame member 29. In the compression process, the flaring member 256 is inserted at the position of the flexible container 251 and expands while pushing the flexible container 251, thereby reducing the capacity of the flexible container 251. At the same time, the refilling space 255 between the frame member 29 and the flexible container 251 is expanded.

The flaring member 256 is a flexible sheet made of polyethylene terephthalate with a 200-μm thickness. The material of the flaring member 256 may be other flexible materials. The flaring member 256 may be left inside the frame member 29 after being inserted therein, or may be taken out through the opening 29*a* to the outside of the frame member 29 afterwards.

Although, in the present embodiment, the flaring member 256 is inserted through the opening 29*a* of the frame member 29, the flexible container 251 is compressed, and the developer T is refilled, the method is not limited thereto. More specifically, the refilling process may be performed after a hole is formed on the frame member 29 and the flaring member 256 is inserted into the frame member 29.

Third Embodiment

Figure 9A:
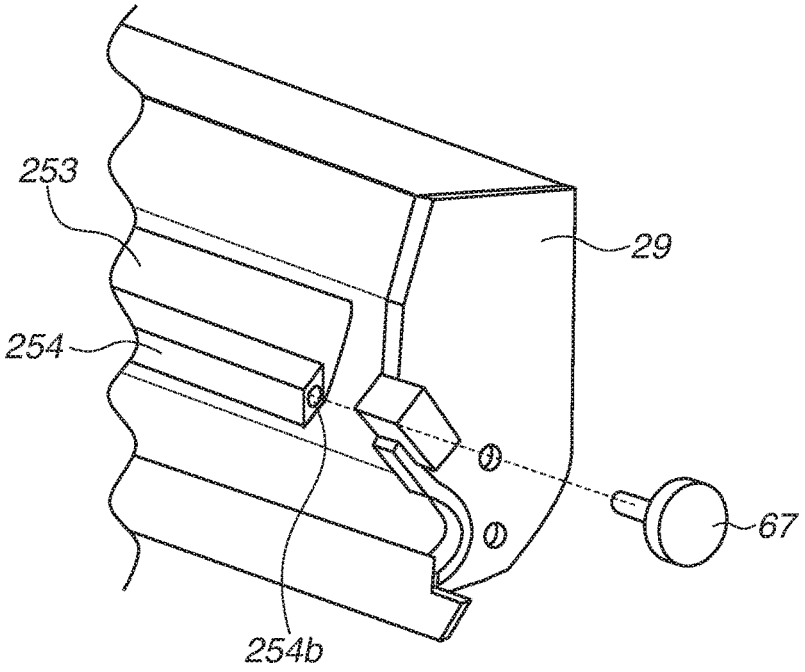
FIG. 9A is a perspective view illustrating a configuration of a frame member and an unsealing member according to a third embodiment.
Figure 9B:
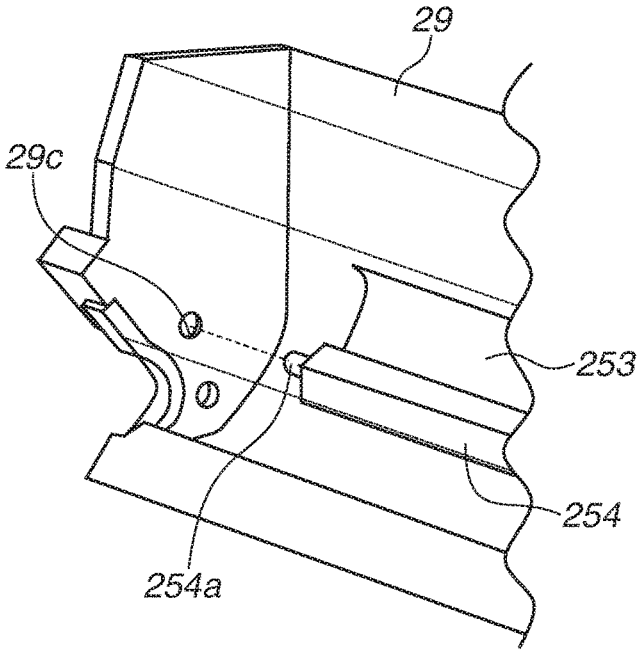
FIG. 9B is a perspective view illustrating a state where the unsealing member is removed from the frame member according to the third embodiment.

FIG. 9A is a perspective view illustrating the configuration of the frame member 29 and the unsealing member 254 according to the third embodiment. FIG. 9B is a perspective view illustrating a state where the unsealing member 254 is removed from the frame member 29 according to the third embodiment. An unsealing gear 67 is fitted into a hole 254*b* of the unsealing member 254 from the outside on the drive side of the frame member 29. On the non-drive side, a shaft 254*a* of the unsealing member 254 is fitted into a hole 29*c* formed inside the frame member 29. The unsealing member 254 is configured to receive a driving force from the apparatus body 2 to be rotatable in the direction indicated by the arrow J illustrated in FIG. 2. Before removing the unsealing member 254, the user needs to complete the separation process of the photosensitive unit 8 and the developing unit 9.

Figure 10A:
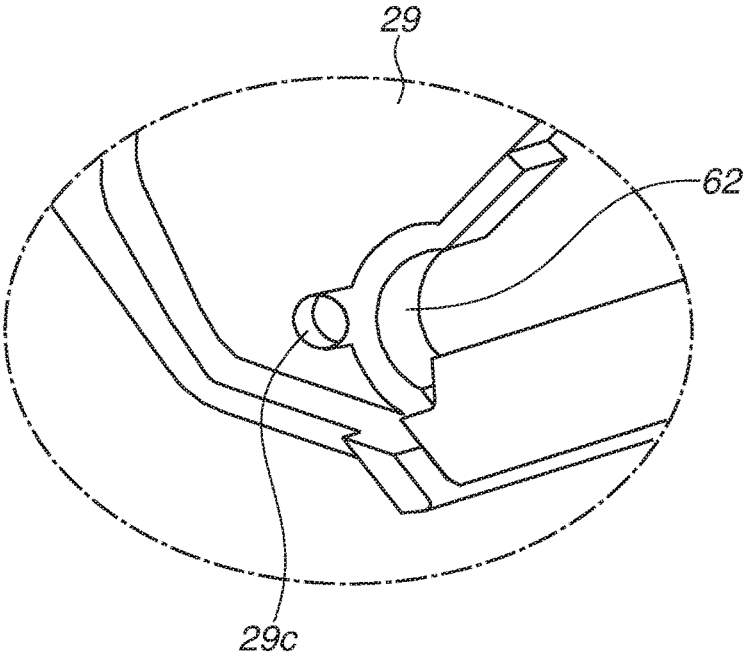
FIGS. 10A and 10B are perspective views illustrating a process for separating a supply roller from the frame member during a developing unit separation process.
Figure 10B:
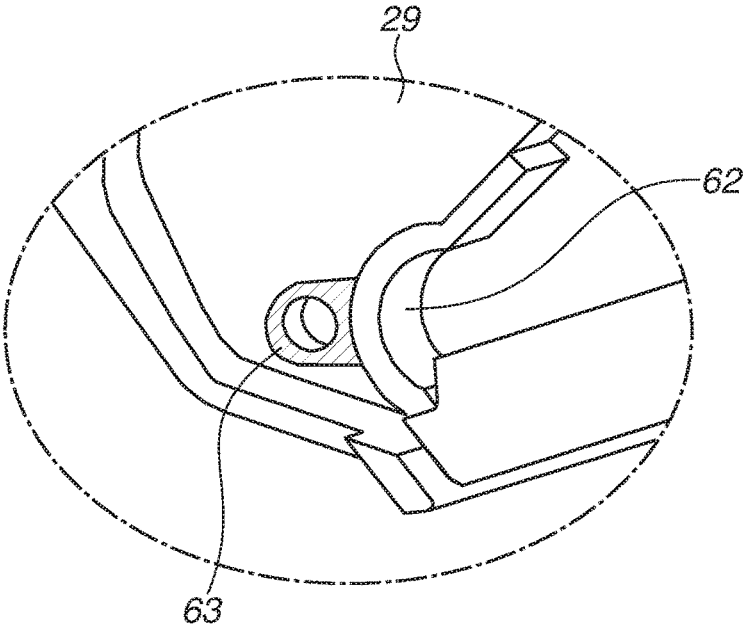

FIGS. 10A and 10B are perspective views illustrating a process for separating, from the frame member 29, the supply roller 61 in the separation process of the developing unit 9. As illustrated in FIG. 10A, when the shaft of the supply roller 61 is fitted into the hole 29*c* of the frame member 29 and the gap between the shaft of the supply roller 61 and the frame member 29 is sealed by the end seals 62, the end seals 62 are taken out and then the supply roller 61 is separated from the frame member 29.

Although the user may perform the removing process of both of the respective end seals 62 on the drive side and the non-drive side, the method is not limited thereto. For example, after performing the removing process only for the end seal 62 on the non-drive side, the supply roller 61 may be pulled out toward the non-drive side to separate it from the frame member 29.

Although, in the above descriptions, the supply roller 61 is fitted into the frame member 29, the supply roller 61 may be fixed to the frame member 29 via a fixing member 63 of the supply roller 61 (refer to FIG. 10B). In this case, the fixing member 63 of the supply roller 61 is separated from the frame member 29. Then, the supply roller 61 is separated from the frame member 29.

Although the user may perform the process for separating the fixing member 63 of the supply roller 61 from the frame member 29 on both of the non-drive side and the drive side, the user may perform the removing process only on either one of the non-drive side and the drive side. For example, when the removing process of the fixing member 63 of the supply roller 61 is performed only on the non-drive side, the supply roller 61 can be separated from the frame member 29 by pulling out the supply roller 61 toward the non-drive side.

[Sealing Member and Unsealing Member Separation Process]

Figure 11A:
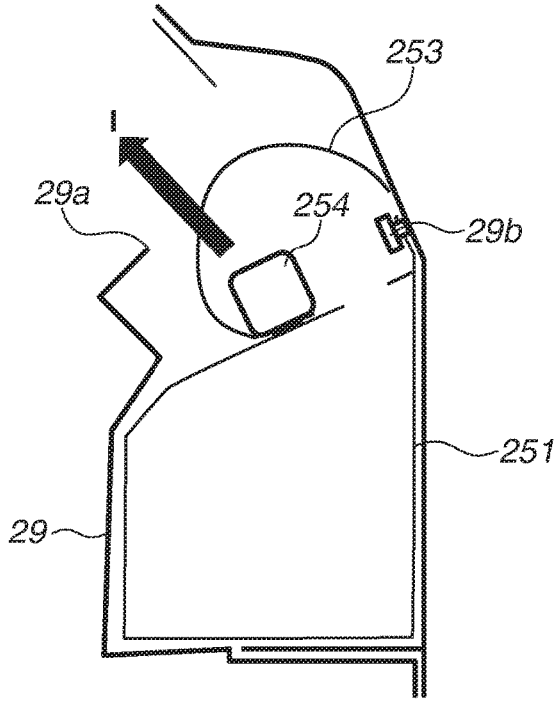
FIG. 11A is a sectional view illustrating a process for separating a sealing member and an unsealing member from the frame member.
Figure 11B:
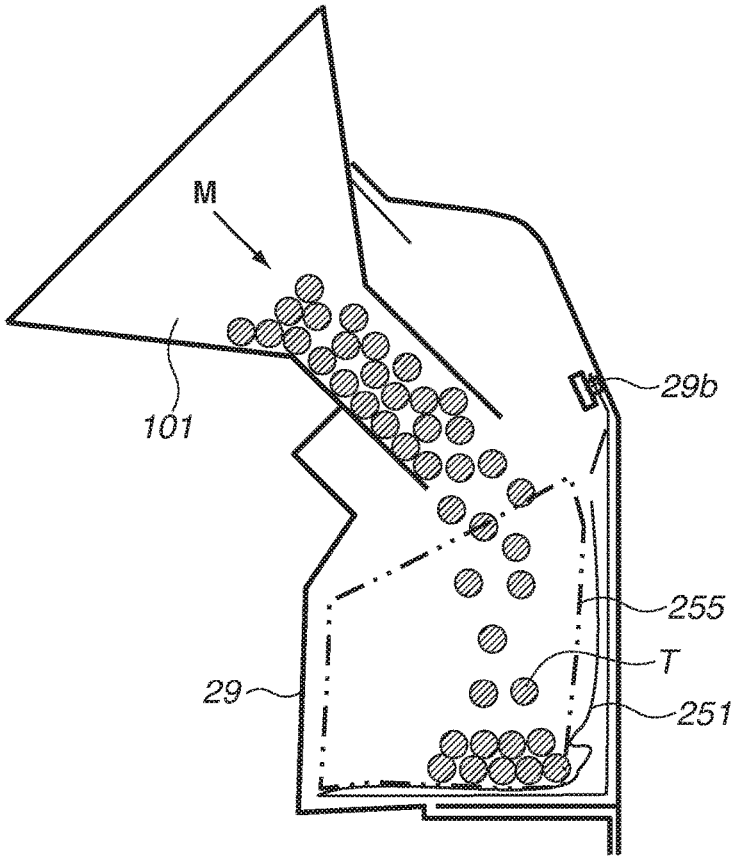
FIG. 11B is a sectional view illustrating a process for refilling developer into a flexible container inside the frame member.

FIG. 11A is a sectional view illustrating a process for separating the sealing member 253 and the unsealing member 254 from the frame member 29. FIG. 11B is a sectional view illustrating a process for refilling the developer into the flexible container 251 inside the frame member 29. Since the sealing member 253 and the unsealing member 254 are engaged with each other, they can be simultaneously separated from the frame member 29. In other words, the remanufacturing method includes a separation process of the sealing member 253 and the unsealing member 254 for separating the sealing member 253 and the unsealing member 254 from the developing unit 9. First of all, the unsealing gear 67 (refer to FIG. 9A) fitted into the hole 254*b* of the unsealing member 254 from the outside of the surface on the drive side of the frame member 29 is removed.

On the non-drive side, the shaft 254*a* of the unsealing member 254 is fitted into the hole 29*c* formed inside the frame member 29. In a state where the unsealing gear 67 on the drive side has been taken out from the unsealing member 254, the shaft 254*a* can be easily pulled out from the hole 29*c*. As illustrated in FIG. 11A, the unsealing member 254 is moved through the opening 29*a* in the direction indicated by an arrow I, so that the unsealing member 254 is separated from the frame member 29.

Then, the unsealing gear 67 once removed is reattached to the frame member 29. Although the unsealing gear 67 is reattached to the frame member 29 in the present embodiment, the hole on the frame member 29 in which the unsealing gear 67 had been inserted may be blocked by a sealing member. In the above-described separation process, the sealing member 253 and the unsealing member 254 are separated from the frame member 29.

[Flexible Container Compression Process]

Figure 12:
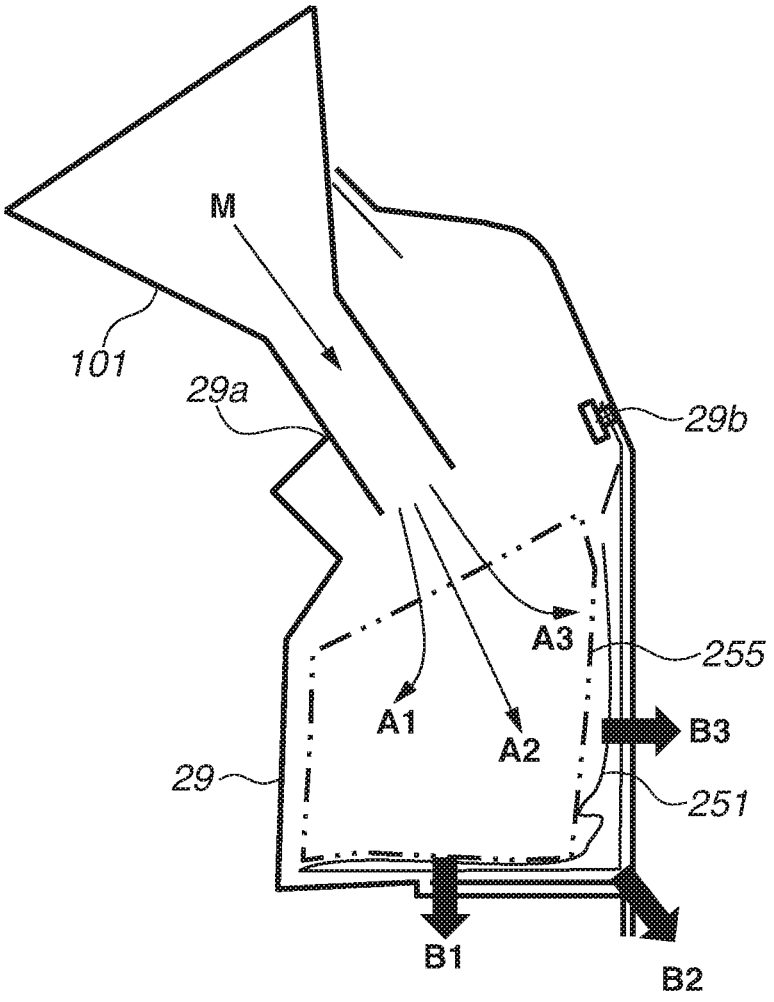
FIG. 12 is a sectional view illustrating the frame member in which a funnel is inserted.

FIG. 12 is a sectional view illustrating the frame member 29 in which the funnel 101 is inserted. A compression process for compressing the flexible container 251 inside the frame member 29 to make the capacity of the flexible container 251 smaller than the capacity of the flexible container 251 filled with the developer T will be described below with reference to FIG. 12.

As illustrated in FIG. 12, in the compression process, the tip portion of the funnel 101 is inserted into the exposed opening 29*a* of the frame member 29. In this case, the tip portion of the funnel 101 reaches the inside of the frame member 29. When air is injected into the funnel 101 in the direction indicated by the arrow M, the injected air advances in the directions indicated by the arrows A (A1 to A3) inside the frame member 29. Then, the pressure of the injected air compresses the flexible container 251 in the directions indicated by the arrows B (B1 to B3) to reduce the capacity of the flexible container 251. Injecting air into the frame member 29 in this way compresses the flexible container 251 to form a space in the frame member 29. Hereinafter, this space is referred to as a refilling space 255.

Although, in this compression process, the flexible container 251 is compressed by injecting air into the frame member 29, it is also possible to directly flare the flexible container 251 using a flaring member (not illustrated) to compress the flexible container 251.

[Developer Refilling Process]

FIG. 11B is a sectional view illustrating a process for refilling the developer into the frame member 29. A process for refilling the developer will be described below with reference to FIG. 11B. In the developer refilling process, the funnel 101 injects the developer T in the direction indicated by the arrow M. The injected developer T falls into the frame member 29 from the tip portion of the funnel 101, and is accumulated in the refilling space 255 inside the frame member 29. In this way, the developer T is filled into the frame member 29.

According to the above-described method, since the unsealing member 254 is separated from the frame member 29, the injection of the developer T is not disturbed by the unsealing member 254. Further, the injection of the developer T is not blocked by the sealing member 253. Therefore, the developer T can be efficiently injected. Using a fixed-rate feeding device having an auger instead of the funnel 101 enables efficient injection of the developer T into the frame member 29.

Although, in the present embodiment, air is used in the compression process to efficiently compress the flexible container 251, the method is not limited thereto. More specifically, in the developer refilling process, the developer T injected from the funnel 101 may be used to compress the flexible container 251 and the developer T may be filled into the frame member 29.

[Developing Unit Reassembling Process] and [Unit Combining Process]

Subsequently, a reassembling process of the developing unit 9 and a unit combining process of the photosensitive unit 8 and the developing unit 9 are performed. Upon completion of the above-described procedure, the assembly process of the cartridge P is completed as illustrated in FIG. 2. The above-described remanufacturing method of the cartridge P enables achievement of a simplified remanufacturing method of the cartridge P.

Fourth Embodiment

Figure 13A:
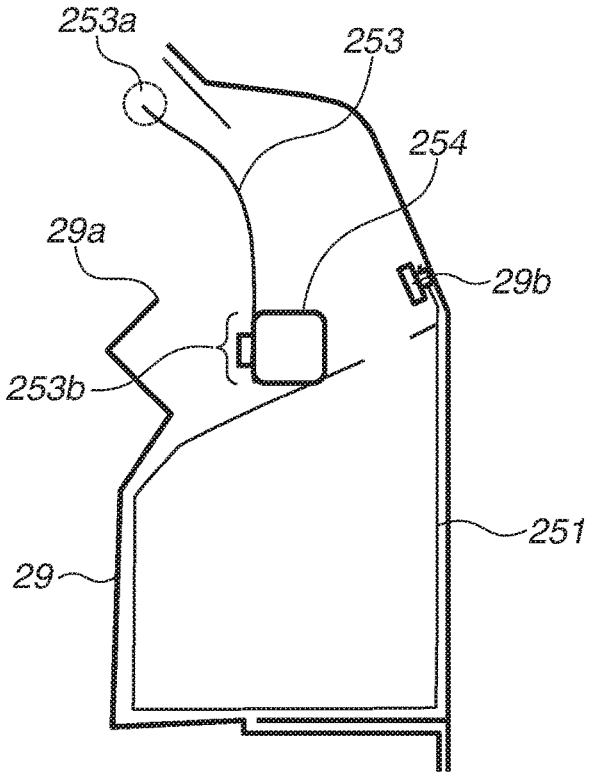
FIG. 13A is a sectional view illustrating a frame member after a supply roller is removed according to a fourth embodiment.
Figure 13B:
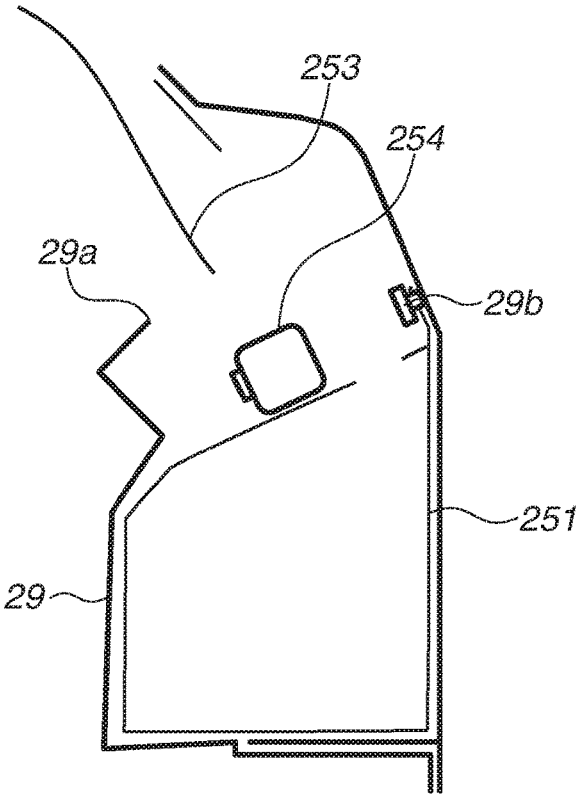
FIG. 13B is a sectional view illustrating a process for separating a sealing member from an unsealing member and taking out the sealing member from the frame member according to the fourth embodiment.

FIG. 13A is a sectional view illustrating the frame member 29 after the supply roller 61 is removed according to the fourth embodiment. FIG. 13B is a sectional view illustrating a process for separating the sealing member 253 from the unsealing member 254 and then taking out the sealing member 253 from the frame member 29 according to the fourth embodiment. The sealing member 253 is engaged with the unsealing member 254 through, for example, thermal welding, ultrasonic welding, or adhesion.

The unsealing member 254 is manually rotated so that a free end 253*a* of the sealing member 253 is positioned at the opening 29*a*. A portion of the sealing member 253 excluding an engaged portion 253*b* engaged with the unsealing member 254 is cut off in the longitudinal direction using a cutter. As illustrated in FIG. 13B, the sealing member 253 is separated from the frame member 29 through the opening 29*a*. The above-described process can be summarized as follows. The remanufacturing method includes a separation process of the sealing member 253 for partly separating the sealing member 253 from the developing unit 9. In the separation process, the sealing member 253 is cut off at a "portion other than the engaged portion" engaged with the unsealing member 254 (including a separation cutoff line 253*c* illustrated in FIGS. 14A and 14B) and then separated from the frame member 29.

In the present embodiment, the sealing member 253 excluding the engaged portion 253*b* engaged with the unsealing member 254 is cut off. However, in the case of welding or adhesion in which the engaged portion 253*b* and the unsealing member 254 are easy to be detached, the sealing member 253 may be detached including the engaged portion 253*b*. In other words, in this separation process, the engaged portion 253*b* engaged with the unsealing member 254 is disengaged, and the sealing member 253 is thereby separated from the frame member 29 of the developing unit 9.

Figure 14A:
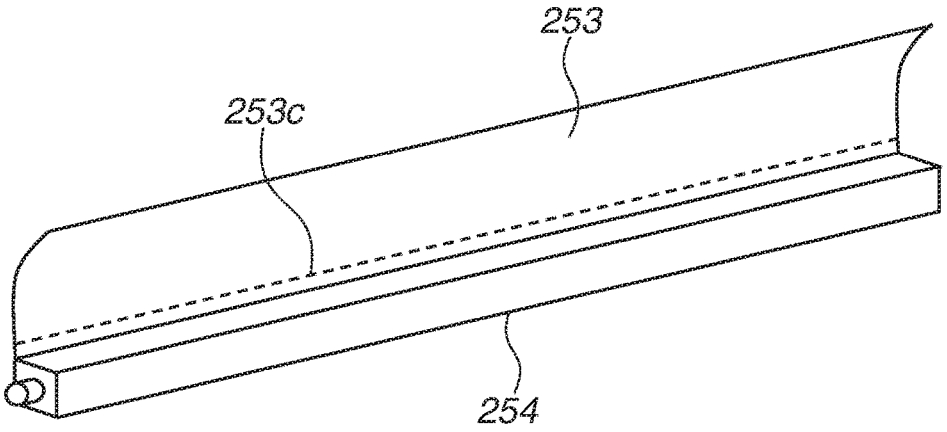
FIG. 14A is a perspective view illustrating a state before the sealing member is separated from the unsealing member.
Figure 14B:
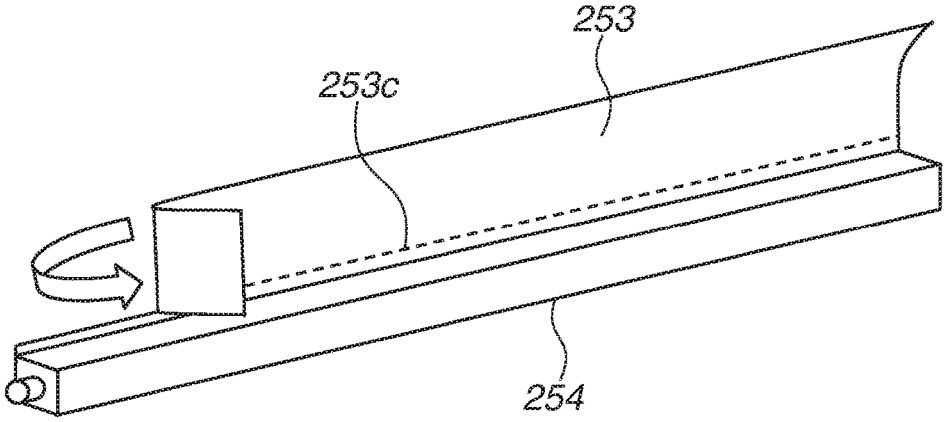
FIG. 14B is a perspective view illustrating a process for separating the sealing member from the unsealing member.

FIG. 14A is a perspective view illustrating a state before the sealing member 253 is separated from the unsealing member 254. FIG. 14B is a perspective view illustrating a process for separating the sealing member 253 from the unsealing member 254. As illustrated in FIG. 14B, the separation cutoff line 253*c* to be used for cutting the sealing member 253 from the unsealing member 254 is formed on the sealing member 253, making it easier to separate the sealing member 253.

[Flexible Container Separation Process]

Figure 15A:
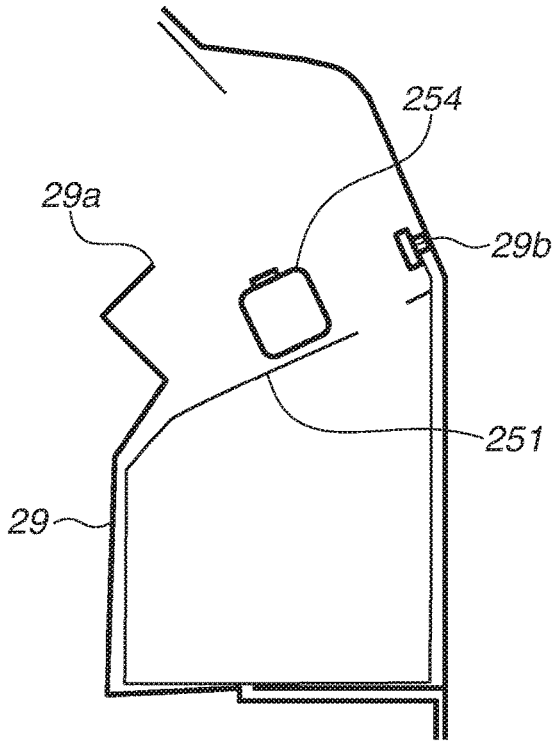
FIG. 15A is a sectional view illustrating a state after the sealing member is separated from the frame member.

FIG. 15A is a sectional view illustrating a state after the sealing member 253 is separated from the frame member 29. Since the flexible container 251 is fixed to the frame member 29 by the fixing portion 29*b* of the frame member 29, the fixing portion 29*b* is first unfixed. In the present embodiment, as a method for fixing the fixing portion 29*b*, a boss of the frame member 29 is put through a hole on the flexible container 251 and then the boss is crushed through ultrasonic swaging.

Figure 15B:
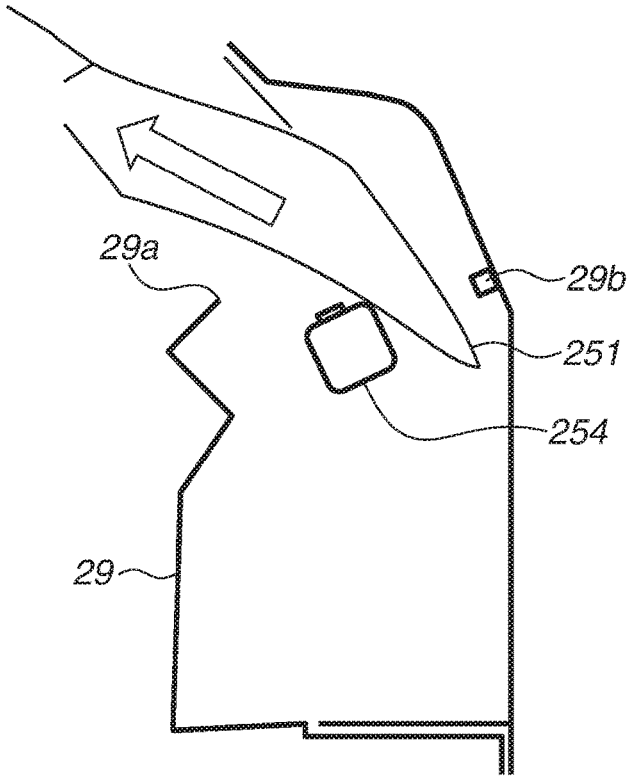
FIG. 15B is a sectional view illustrating a process for separating a flexible container from the frame member.

FIG. 15B is a sectional view illustrating a process for separating the flexible container 251 from the frame member 29. As illustrated in FIG. 15B, if the above-described boss is cut off, the flexible container 251 can be taken out from the frame member 29.

Although, in the present embodiment, the fixing portion 29*b* is unfixed and then the flexible container 251 is taken out from the frame member 29, the flexible container 251 may be detached from the frame member 29 by cutting off a portion excluding the fixing portion 29*b*. After the flexible container 251 is detached from the frame member 29 in this way, the flexible container 251 is pulled out and separated through the opening 29*a*. According to the above-described method, in the developer refilling process, the developer T is efficiently injected into the frame member 29 without the opening 29*a* being blocked by the sealing member 253.

Although, in the fourth embodiment, only the sealing member 253 is separated from the unsealing member 254 and the flexible container 251 is thereby separated from the frame member 29, the method is not limited thereto. More specifically, similar to the third embodiment, the sealing member 253 may be separated from the frame member 29 together with the unsealing member 254 and the flexible container 251 may be thereby separated from the frame member 29 in the method according to the fourth embodiment.

Although, in the third embodiment, the sealing member 253 is separated from the frame member 29 together with the unsealing member 254, the method is not limited thereto. More specifically, similar to the fourth embodiment, only the sealing member 253 may be separated from the unsealing member 254 and the flexible container 251 may be thereby separated from the frame member 29 in the method according to the third embodiment.

Fifth Embodiment

In the fifth embodiment, the remanufacturing method of the developing unit 9 includes a communication hole processing process for processing a first communication hole 109 for refilling the developer T into the frame member 29, and a communication hole sealing process for sealing the first communication hole 109 to seal the developer T filled in the frame member 29. The remanufacturing method will be described in detail below.

[Communication Portion Processing Process]

Figure 16:
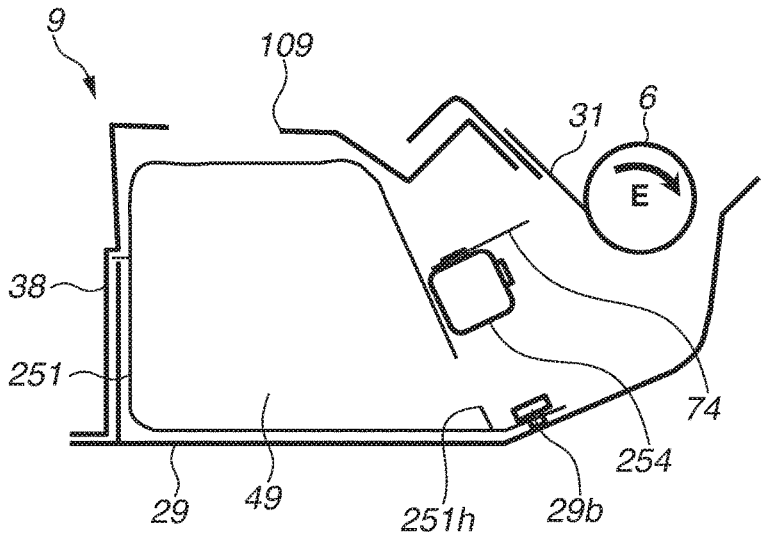
FIG. 16 is a sectional view illustrating a process for processing a first communication hole on a frame member of a developing unit separated in a unit separation process according to a fifth embodiment.

FIG. 16 is a sectional view illustrating a process for processing the first communication hole 109 on the frame member 29 of the developing unit 9 separated by the unit separation process according to the fifth embodiment. First of all, it is desirable to hold the developing unit 9 so that the surface having the fixing portion 29*b* is oriented downward in the gravity direction. Then, the first communication hole 109 is processed on the vertically upper surface of the frame member 29 in the above-described orientation. A developer refilling device is to be inserted into the first communication hole 109 from the outside of the frame member 29 in the developer refilling process (described below). Therefore, the first communication hole 109 needs to be larger than the tip portion of the developer refilling device. However, the first communication hole 109 may have any shape as long as it is larger than the tip portion of the developer refilling device.

[Developer Refilling Process]

Figure 17A:
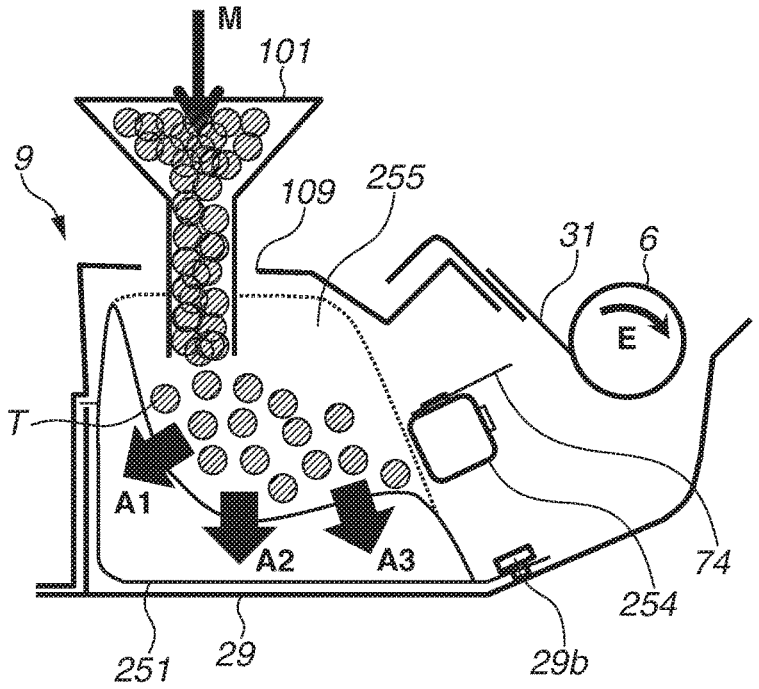
FIGS. 17A and 17B are sectional views illustrating a process in which developer is refilled into the frame member and a flexible container is folded.
Figure 17B:
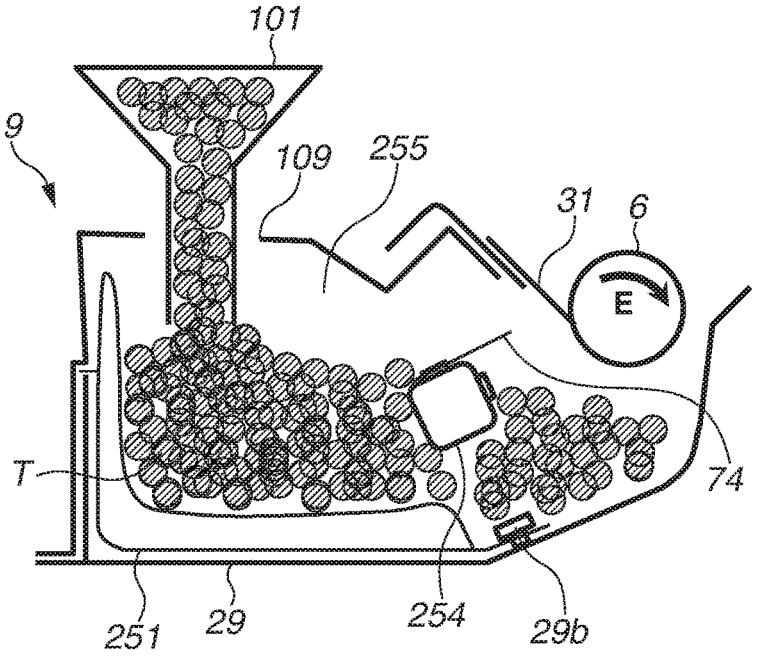

FIGS. 17A and 17B are sectional views illustrating a process in which the developer is directly refilled into the frame member 29 and the flexible container 251 is folded. In the developer refilling process, as illustrated in FIG. 17A, the developer T is injected in the direction indicated by the arrow M using the funnel 101. The injected developer T falls into the frame member 29 from the tip portion of the funnel 101, and is accumulated in the refilling space 255 inside the frame member 29. In this case, the flexible container 251 receives a force in the directions indicated by the arrows A (A1 to A3) illustrated in FIG. 17A by the gravity applied to the developer T, and is thereby compressed. Then, as illustrated in FIG. 17B, the developer T is filled into the flexible container 251.

Although, in the present embodiment, the funnel 101 is used for refilling the developer T, the device used for refilling the developer T is not limited thereto. For example, a fixed-rate feeding device having an auger may be used instead of the funnel 101. Using a fixed-rate feeding device having an auger enables efficient injection of the developer T into the frame member 29.

[Communication Portion Sealing Process]

Figure 18:
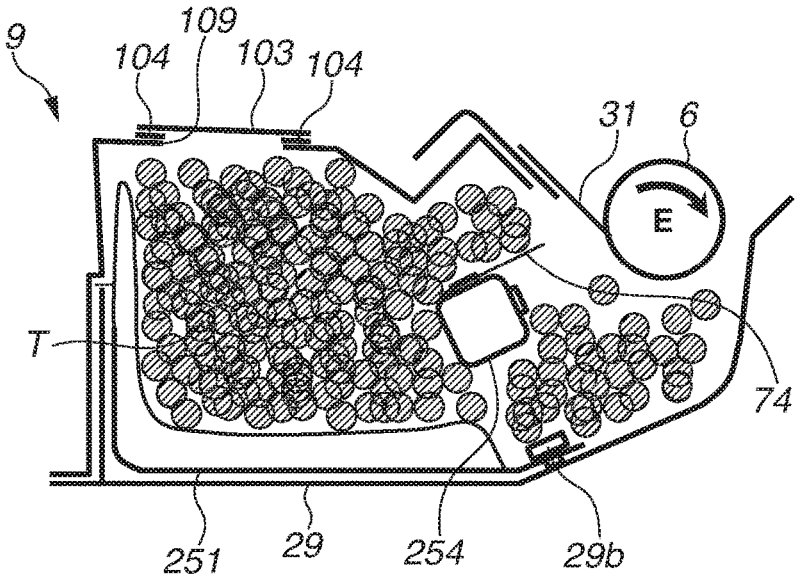
FIG. 18 is a sectional view illustrating a process for sealing the first communication hole.

FIG. 18 is a sectional view illustrating a process for sealing the first communication hole 109. This process is performed for attaching a resealing member 103 for sealing the communication portion, to the first communication hole 109 using a two-sided tape 104 so as to seal the first communication hole 109, and thereby preventing leakage of the developer T from the frame member 29. It is desirable to attach the resealing member 103 in a similar orientation to that when refilling the developer T, as illustrated in FIG. 18, i.e., in a state where the developing unit 9 is held so that the first communication hole 109 is oriented vertically upward. Then, the resealing member 103 is attached to the frame member 29 so as to cover the first communication hole 109.

The resealing member 103 may have any shape as long as it covers the first communication hole 109 to prevent leakage of the developer T from the frame member 29. Further, the resealing member 103 may be attached by using an adhesive instead of a two-sided tape. Further, the resealing member 103 may not necessarily be a member to be attached using the two-sided tape 104 or an adhesive, and may be a member to be fitted into the first communication hole 109, such as a cap. In the above-described processes, the developing unit 9 refilled with the developer T has been remanufactured.

[Unit Combining Process]

Subsequently, the user performs the unit combining process for combining the photosensitive unit 8 and the developing unit 9.

Sixth Embodiment

[Compression Process]

Figure 19A:
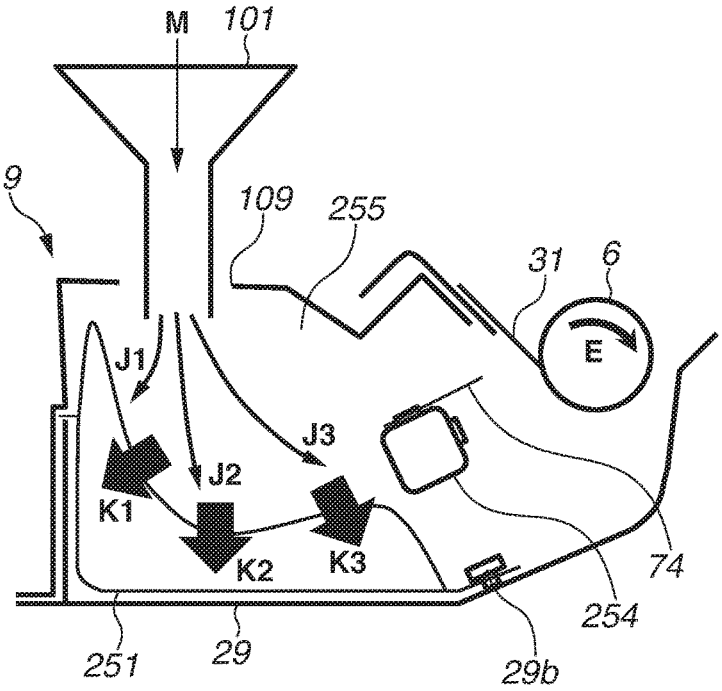
FIG. 19A is a sectional view illustrating the frame member in which a funnel is inserted before developer is refilled.

FIG. 19A is a sectional view illustrating the frame member 29 in which the funnel 101 is inserted, before the developer is refilled. A compression process for compressing the flexible container 251 inside the frame member 29 to make the capacity of the flexible container 251 smaller than the capacity of the flexible container 251 filled with the developer T will be described below with reference to FIG. 19A. In the compression process, as illustrated in FIG. 19A, the tip portion of the funnel 101 is inserted into the first communication hole 109. In this case, the tip portion of the funnel 101 reaches the inside of the frame member 29. When compressed air is injected into the funnel 101 in the direction indicated by the arrow M, the injected air advances in the directions indicated by the arrows J (J1 to J3) inside the frame member 29. Then, the pressure of the injected air compresses the flexible container 251 in the directions indicated by arrows K (K1 to K3) to reduce the capacity of the flexible container 251.

Figure 19B:
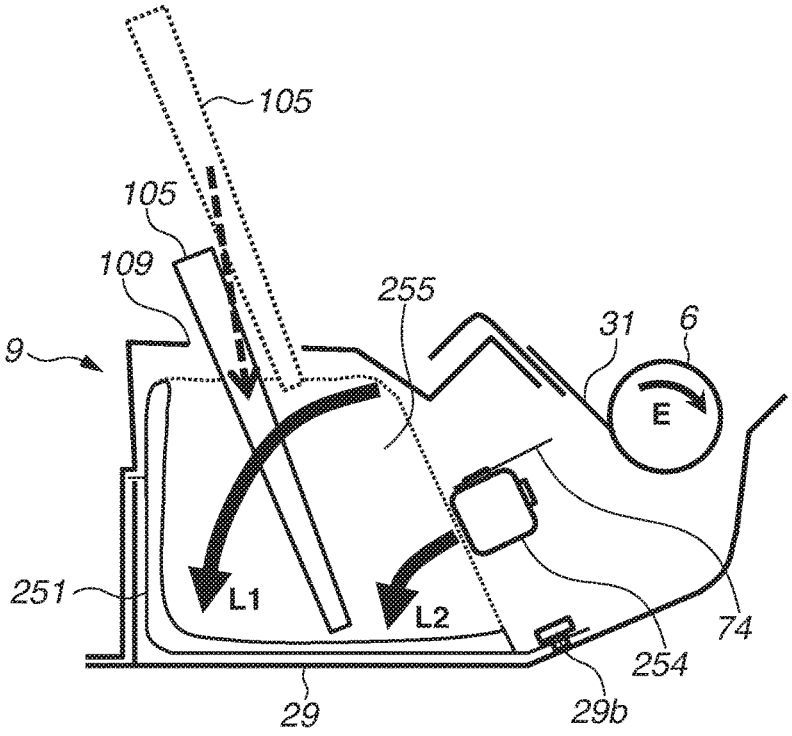
FIG. 19B is a sectional view illustrating the frame member in which a push-in member is inserted before developer is refilled.

Although, in the sixth embodiment, compression using air is performed as a compression process, the compression method is not limited thereto. For example, the flexible container 251 may be compressed using a pushing-in member 105 having higher rigidity than the flexible container 251, as illustrated in FIG. 19B. When the pushing-in member 105 is used, the flexible container 251 can be folded along the frame member 29 by compressing it in the directions indicated by arrows L (L1 to L2).

Performing the above-described compression process after the communication portion processing process and before the developer refilling process enables more stable execution of the developer refilling process even when the flexible container 251 has high elasticity. Further, reducing the capacity of the flexible container 251 enables refilling of larger amount of developer T.

Seventh Embodiment

In the seventh embodiment, since the unit separation process included in the fifth embodiment is not performed, the communication portion processing process and subsequent processes will be described below. In the seventh embodiment, the remanufacturing method of the developing unit 9 includes a communication hole processing process for processing a second communication hole 110 for refilling the developer T into the frame member 29, and a communication hole sealing process for sealing the second communication hole 110 to seal the developer T filled in the frame member 29. The remanufacturing method will be described in detail below.

[Communication Portion Processing Process]

Figure 20:
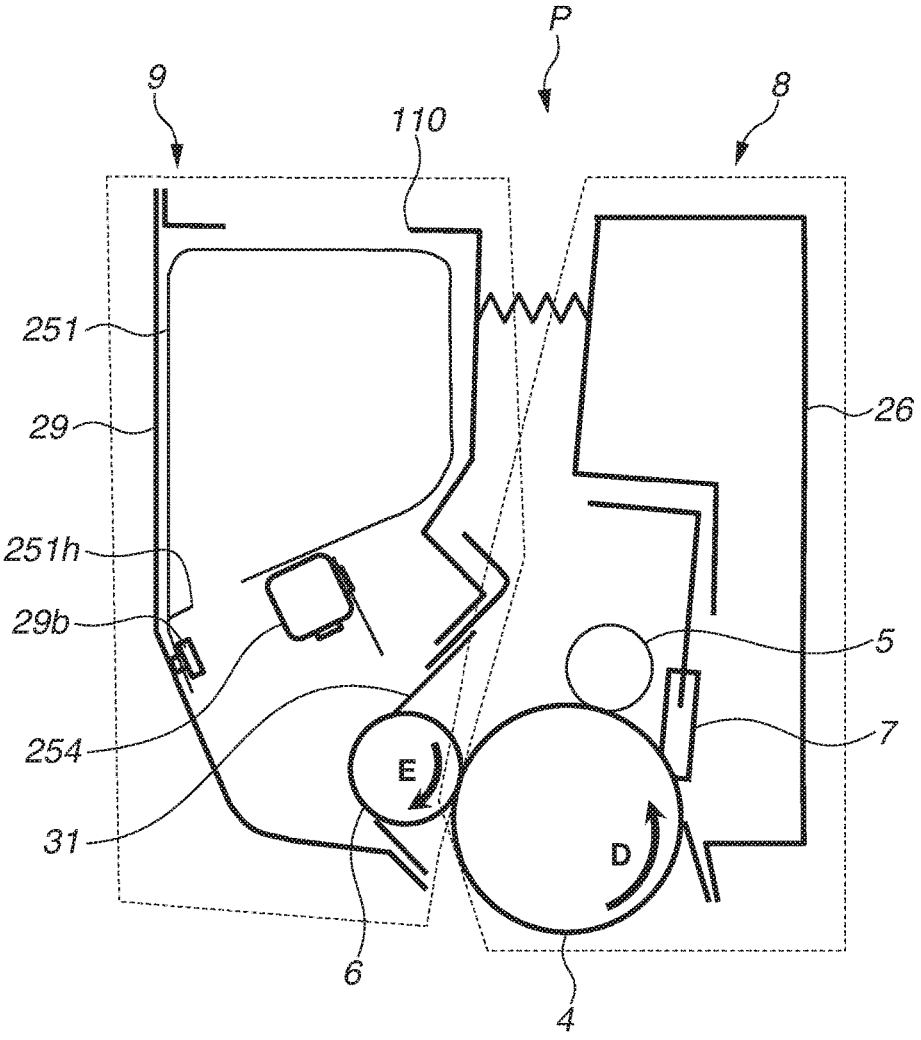
FIG. 20 is a sectional view illustrating a process for processing a second communication hole on a frame member.

FIG. 20 is a sectional view illustrating a process for processing the second communication hole 110 on the frame member 29. First of all, it is desirable to hold the cartridge P in a similar orientation to that when installing it in the image forming apparatus 1. Then, the second communication hole 110 is processed on the vertically upper surface of the frame member 29 in the above-described orientation. A developer refilling device is to be inserted into the second communication hole 110 in the developer refilling process (described below). Therefore, the second communication hole 110 needs to be larger than the tip portion of the developer refilling device. However, the second communication hole 110 may have any shape as long as it is larger than the tip portion of the developer refilling device.

[Compression Process]

Figure 21:
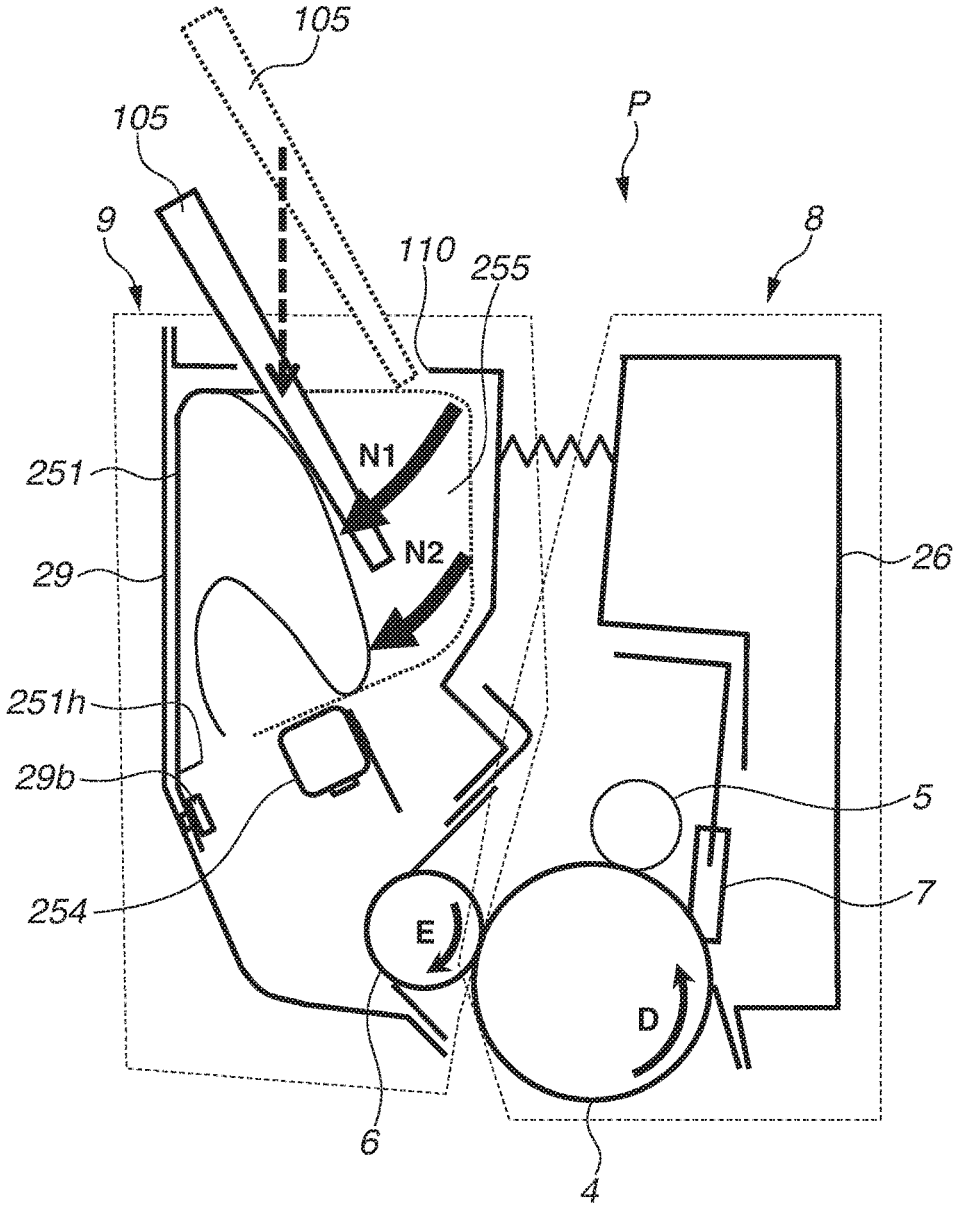
FIG. 21 is a sectional view of the frame member illustrating a process for compressing the flexible container using a pushing-in member to make a capacity of the flexible container smaller than a capacity of the flexible container filled with developer.

FIG. 21 is a sectional view of the frame member 29 illustrating the compression process for compressing the flexible container 251 using the pushing-in member 105 to make the capacity of the flexible container 251 smaller than the capacity of the flexible container 251 filled with the developer T. The pushing-in member 105 having higher rigidity than the flexible container 251 is used to compress the flexible container 251. The pushing-in member 105 is inserted into the frame member 29 through the second communication hole 110 downward in the gravity direction, and then a force is applied to the flexible container 251 in the directions indicated by arrows N (N1 to N2). The flexible container 251 is thereby folded and the capacity of the flexible container 251 is reduced. Compressing the flexible container 251 in this way forms the refilling space 255.

[Developer Refilling Process]

Figure 22:
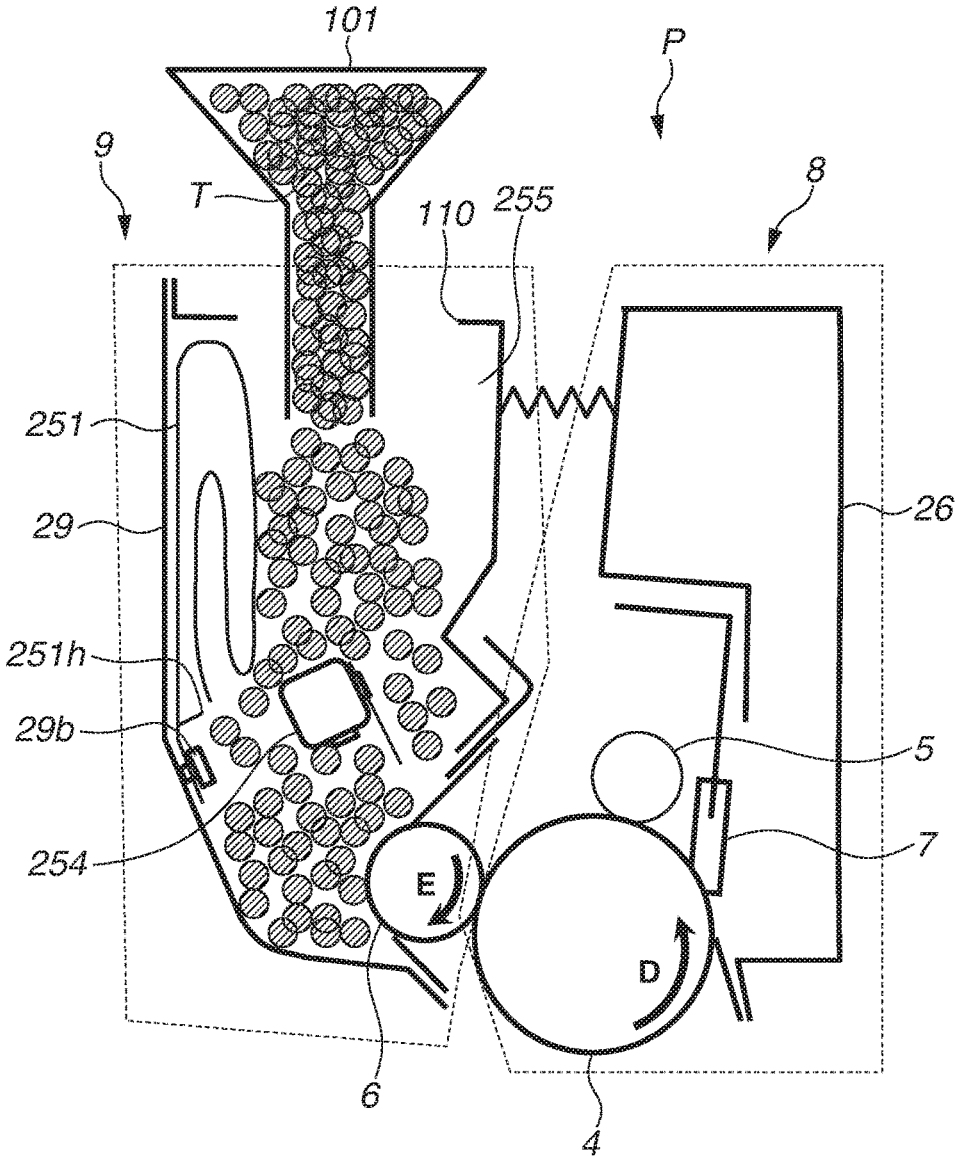
FIG. 22 is a sectional view illustrating the frame member when the developer is refilled.

FIG. 22 is a sectional view illustrating the frame member 29 when the developer is refilled. A method for refilling the developer T is similar to that according to the fifth embodiment, in which the funnel 101 is used. In the developer refilling process, as illustrated in FIG. 22, the developer T is injected into the frame member 29 downward in the gravity direction using the funnel 101. The injected developer T falls into the frame member 29 from the tip portion of the funnel 101, and is accumulated in the refilling space 255 inside the frame member 29. Similar to the fifth embodiment, the device used for refilling the developer T is not limited to the funnel 101. For example, a fixed-rate feeding device having an auger may be used instead of the funnel 101.

[Communication Portion Sealing Process]

Figure 23:
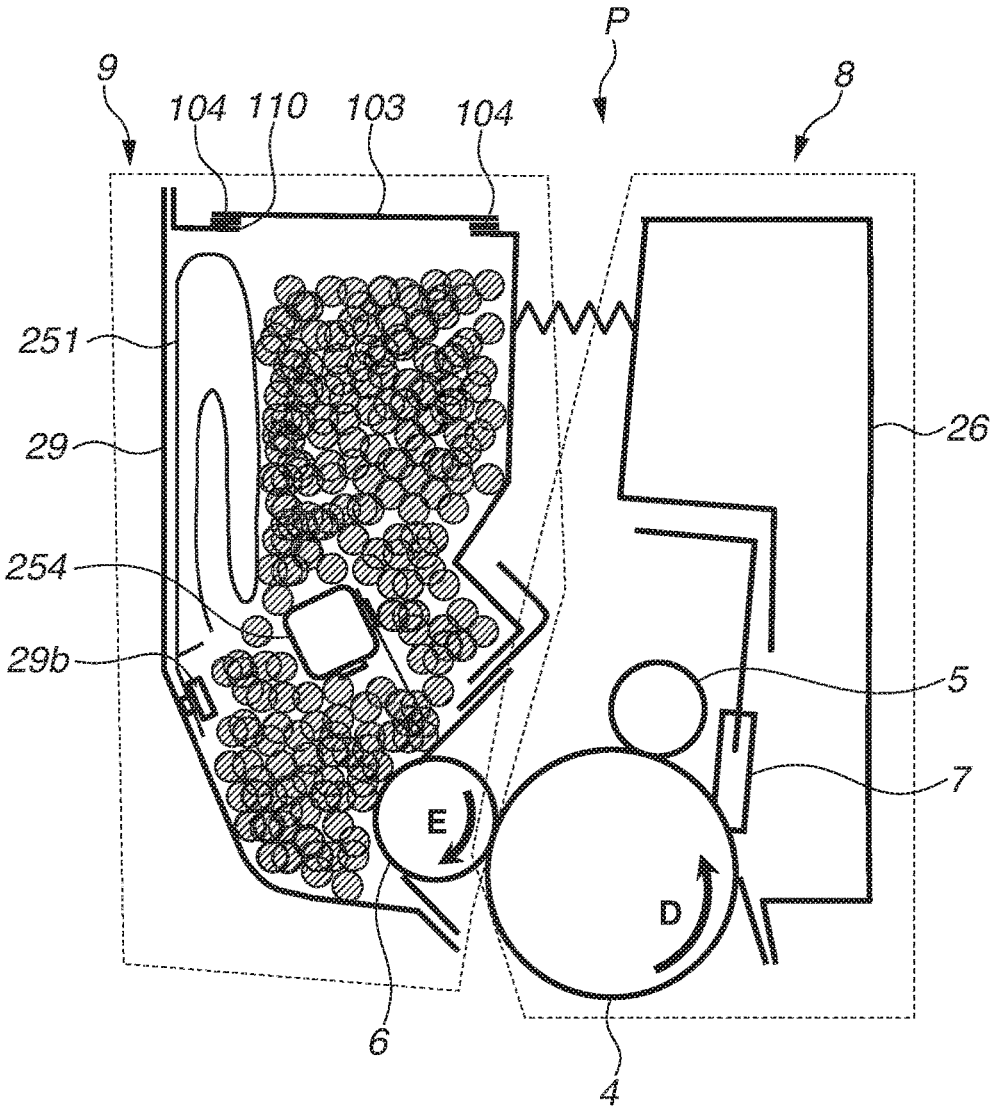
FIG. 23 is a sectional view of the frame member illustrating a process for sealing the second communication hole.

FIG. 23 is a sectional view of the frame member 29 illustrating a process for sealing the second communication hole 110. Similar to the fifth embodiment, this process is performed for attaching the resealing member 103 for sealing the second communication hole 110, to the second communication hole 110 using the two-sided tape 104, and thereby preventing leakage of the developer T from the frame member 29. It is desirable to attach the resealing member 103 in a similar orientation to that when refilling the developer T, as illustrated in FIG. 23, i.e., in a state where the cartridge P is held so that the second communication hole 110 is oriented vertically upward. Then, the resealing member 103 is attached to the frame member 29 so as to cover the second communication hole 110.

The resealing member 103 may have any shape as long as it covers the second communication hole 110 to prevent leakage of the developer T from the frame member 29. Further, the resealing member 103 may be attached by using an adhesive instead of a two-sided tape. Further, the resealing member 103 may not necessarily be a member to be attached using a two-sided tape or an adhesive, and may be a member to be fitted into the second communication hole 110, such as a cap. The above-described process enables achievement of a simplified remanufacturing method of the cartridge P, as illustrated in FIG. 23, without requiring the unit separation process and the unit combining process.

According to the configurations of the first to the seventh embodiments, the remanufacturing method of the developing unit 9 becomes simplified as compared with the conventional technique. The configurations or processes according to the first to the seventh embodiments can be suitably combined.

Although, in the first to the seventh embodiments, the description has been given of the cartridge P including the developing unit 9 and the photosensitive unit 8, the configuration is not limited thereto as long as the cartridge P includes the developing unit 9. In other words, the first to the seventh embodiments are also applicable to a developing device, a cartridge, and an image forming apparatus as long as these include the developing unit 9.

According to an embodiment of the present invention, it is possible to provide a remanufacturing method of a developer accommodating unit including a flexible container.

While the present invention has been described with reference to embodiments, it is to be understood that the invention is not limited to the disclosed embodiments. The scope of the following claims is to be accorded the broadest interpretation so as to encompass all such modifications and equivalent structures and functions.

What is claimed is:

1. A remanufacturing method of a developer accommodating unit including a frame member, and a flexible container configured to accommodate developer and provided with a plurality of openings for discharging the developer into the frame member, the frame member being configured to accommodate the flexible container, and a fixing portion configured to attach the flexible container to the frame member, the remanufacturing method comprising:

refilling developer between the frame member and the flexible container, so that refilled developer is accumulated inside the frame member while the refilled developer is filled from outside of the frame member to inside of the frame member to contact the flexible container.

2. The remanufacturing method according to claim 1, wherein the flexible container inside the frame member is compressed before or when refilling the developer.

3. The remanufacturing method according to claim 1, further comprising processing a frame member communication hole on the frame member.

4. The remanufacturing method according to claim 3, further comprising communication hole sealing for sealing the frame member communication hole.

5. The remanufacturing method according to claim 4, wherein the refilling refills developer through the frame member communication hole.

6. The remanufacturing method according to claim 1, wherein the developer accommodating unit further includes a sealing member configured to seal the plurality of openings and to expose the plurality of openings when the sealing member is moved, and an unsealing member attached to the sealing member and configured to move the sealing member to unseal the plurality of openings, the remanufacturing method further comprising removing the unsealing member from the developer accommodating unit.

7. The remanufacturing method according to claim 1, wherein the developer accommodating unit further includes a sealing member configured to seal the plurality of openings and to expose the plurality of openings when the sealing member is moved, and an unsealing member attached to the sealing member and configured to move to unseal the plurality of openings, the remanufacturing method further comprising separating at least a part of the sealing member from the frame member.

8. The remanufacturing method according to claim 7, wherein separating at least a part of the sealing member from the frame member includes cutting off the sealing member at a portion other than an engaged portion engaged with the unsealing member.

9. The remanufacturing method according to claim 7, wherein separating at least a part of the sealing member from the frame member includes disengaging an engaged portion engaged with the unsealing member.

10. A developing device remanufacturing method of a developing device including a developer bearing member and the developer accommodating unit remanufactured by the remanufacturing method according to claim 1, wherein the developer bearing member is configured to develop an electrostatic image formed on an image bearing member, the developing device remanufacturing method comprising:

attaching the developer bearing member to the frame member.

11. A process cartridge remanufacturing method of a process cartridge including a developer bearing member and the developer accommodating unit remanufactured by the remanufacturing method according to claim 1, wherein the developer bearing member is configured to develop an electrostatic image formed on an image bearing member, the process cartridge remanufacturing method comprising:

attaching the image bearing member to the frame member.

12. A remanufacturing method of a developer accommodating unit including a frame member, a flexible container configured to accommodate developer and provided with an opening for discharging the developer into the frame member, a rotatable member, and a sheet member attached to the rotatable member, wherein the frame member is configured to accommodate the flexible container, the rotatable member, and the sheet member, and includes a fixing portion configured to attach the flexible container to the frame member, and wherein the flexible container is deformable to change a capacity of the flexible container, the remanufacturing method comprising:

refilling developer into the frame member including the flexible container.

13. The remanufacturing method according to claim 12, wherein the refilling refills the developer between the frame member and the flexible container.

14. The remanufacturing method according to claim 12, wherein the sheet member is a sheet member which is peeled from the flexible container.

15. The remanufacturing method according to claim 14, wherein the flexible container is provided with a plurality of the openings.

16. The remanufacturing method according to claim 15, wherein the remanufacturing method further comprises removing at least a part of the sheet member.

17. The remanufacturing method according to claim 15, wherein the remanufacturing method further comprises removing the rotatable member.

18. The remanufacturing method according to claim 15, further comprising processing a frame member communication hole on the frame member.

19. The remanufacturing method according to claim 18, further comprising communication hole sealing for sealing the frame member communication hole.

* * * * *